US011406164B2

(12) United States Patent
Komiyama et al.

(10) Patent No.: US 11,406,164 B2
(45) Date of Patent: Aug. 9, 2022

(54) SLIDE FASTENER JOINED TO FLEXIBLE MATERIAL

(71) Applicant: YKK Corporation, Tokyo (JP)

(72) Inventors: Aoi Komiyama, Kurobe (JP); Yuichi Miyazaki, Kurobe (JP); Mitsuo Tsuzuyama, Kurobe (JP); Shigeyoshi Takazawa, Kurobe (JP); Shigeto Takahashi, Kurobe (JP)

(73) Assignee: YKK Corporation, Tokyo (JP)

( * ) Notice: Subject to any disclaimer, the term of this patent is extended or adjusted under 35 U.S.C. 154(b) by 126 days.

(21) Appl. No.: 16/765,956

(22) PCT Filed: Mar. 7, 2018

(86) PCT No.: PCT/JP2018/008873
§ 371 (c)(1),
(2) Date: May 21, 2020

(87) PCT Pub. No.: WO2019/106857
PCT Pub. Date: Jun. 6, 2019

(65) Prior Publication Data

US 2020/0359753 A1 Nov. 19, 2020

(30) Foreign Application Priority Data

Nov. 30, 2017 (JP) ..... PCT/JP2017/043168

(51) Int. Cl.
*A44B 19/26* (2006.01)

(52) U.S. Cl.
CPC ..... *A44B 19/26* (2013.01)

(58) Field of Classification Search
CPC ..... A44B 19/26; A44B 19/12; A44B 19/346; A44B 19/34
See application file for complete search history.

(56) References Cited

U.S. PATENT DOCUMENTS 1,933,290 A * 10/1933 Winterhalter ..... A44B 19/34 24/414
3,430,304 A * 3/1969 Swainson ..... A44B 19/54 24/394

(Continued)

FOREIGN PATENT DOCUMENTS

CN 101878981 A 11/2010
JP S46-007017 B1 2/1971

(Continued)

OTHER PUBLICATIONS

International Search Report, PCT Application No. PCT/JP2018/008873, dated May 29, 2018.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

Slide fastener coupled to flexible member includes: a pair of fastener stringers, each of the fastener stringers having a fastener tape provided with a first side-edge portion and a second side-edge portion which extend in an elongation direction of the fastener tape, and a fastener element provided on the first side-edge portion side; and one or more sliders for opening and closing the pair of fastener stringers. The fastener tape includes a first tape region onto which a flap of the flexible member is overlaid and a second tape region positioned between the first tape region and the second side-edge portion. The flap is interposed between the first tape region and the second tape region.

20 Claims, 15 Drawing Sheets

(56) References Cited

U.S. PATENT DOCUMENTS

| | | | | |
|---|---|---|---|---|
| 3,487,510 | A * | 1/1970 | Frohlich | H02K 1/32 24/393 |
| 5,129,127 | A * | 7/1992 | Hamatani | A44B 19/34 24/394 |
| 6,877,192 | B2 * | 4/2005 | Tominaga | A44B 19/34 24/381 |
| 7,143,878 | B2 * | 12/2006 | Selvi | A45C 5/03 190/103 |
| 8,083,040 | B2 * | 12/2011 | Chiang | A45C 13/103 190/119 |
| 10,602,811 | B2 * | 3/2020 | Adachi | A44B 19/34 |
| 2006/0016052 | A1 * | 1/2006 | Horikawa | D03D 1/00 24/393 |
| 2010/0281657 | A1 | 11/2010 | Ujihara et al. | |
| 2014/0224608 | A1 * | 8/2014 | Tang | A45C 13/002 190/124 |

FOREIGN PATENT DOCUMENTS

| | | | |
|---|---|---|---|
| JP | S51-135709 | U | 11/1976 |
| JP | S58-36811 | U | 3/1983 |
| JP | S59-179606 | U | 11/1984 |
| JP | 3208550 | U | 1/2017 |

OTHER PUBLICATIONS

Office Action, Chinese Patent Application No. 201880077339.8, dated Mar. 23, 2022, 13 pages.

* cited by examiner

SLIDE FASTENER JOINED TO FLEXIBLE MATERIAL

TECHNICAL FIELD

The present disclosure is directed to a slide fastener coupled to a flexible member, a related method, and a fastener tape.

BACKGROUND ART

Patent literature 1 discloses a slide fastener in which a tape of one stringer can be positioned over a tape surface of the other stringer across engaged elements. This literature describes at page 4, lines 3-5 that density of warp threads in the flap is set lesser than other portions so that easier folding is enabled.

Patent literature 2 discloses a slide fastener tape adapted for handicrafts. This literature discloses at page 3, lines 5 to 2 from bottom that apertures defined by zigzag weft thread are used as passages for a handicraft yarn (See FIG. 2 of the literature).

CITATION LIST

Patent Literature

Patent literature 1 Japanese Utility-model application Laid-open No. 58-36811

Patent literature 2 Japanese Utility-model application Laid-open No. 51-135709

SUMMARY

Technical Problem

As shown in FIG. 26, it has been widely accustomed in a field of sewing industry that, when a fastener tape 10 provided with a fastener element 30 is sewn to a flexible member 100, a bias tape 900 is used to conceal a sewn part of the fastener tape 10 and the flap 101 of the flexible member 100. Exposures of the side-edge portion 109 of the flexible member 100 and the second side-edge portion 2 of the fastener tape 10 are prevented by the bias tape 900, thus appearance would be improved. However, this method requires a level of skill for handling the bias tape 900. Even if this is tolerable, burden associated with sewing the flexible member 100 and the fastener tape 10 might be not negligible. The present inventors have newly found a technical problem to reduce a burden associated with sewing a flexible member and a fastener tape.

Solution to Problem

A slide fastener according to an aspect of the present disclosure may be a slide fastener coupled to a flexible member, the slide fastener including: a pair of fastener stringers, each of the fastener stringers having a fastener tape provided with a first side-edge portion and a second side-edge portion which extend in an elongation direction of the fastener tape, and a fastener element provided on the first side-edge portion side; and one or more sliders for opening and closing the pair of fastener stringers, wherein the fastener tape includes a first tape region onto which a flap of the flexible member is overlaid and a second tape region positioned between the first tape region and the second side-edge portion, and the flap is interposed between the first tape region and the second tape region.

In some instances, the second tape region has a thickness that differs from a thickness of the first tape region.

In some instances, the second tape region is thinner than at least a part of the first tape region.

In some instances, the second tape region includes a respective warp thread having a different thickness compared with a respective warp thread in the first tape region.

In some instances, the warp threads in the second tape region are thinner than the warp threads in the first tape region.

In some instances, the second tape region includes a respective warp thread that differs from a respective warp thread in the first tape region.

In some instances, the warp thread in the second tape region is made of filaments, each of these filaments thinner than a filament of the warp thread in the first tape region.

In some instances, the first tape region has a twill-woven structure, and the second tape region has a plain-woven structure.

In some instances, the fastener tape further includes a third tape region positioned between the first tape region and the second tape region, the first tape region including a weft thread and a plurality of warp threads, the second tape region including the weft thread and a plurality of warp threads, and the third tape region consisting of the weft thread.

In some instances, the flap of the flexible member has a side-edge portion covered by a covering portion formed by folding of the fastener tape at the third tape region.

In some instances, the fastener tape includes a first tape member provided with at least the first tape region and a second tape member provided with at least the second tape region, and the first tape member and the second tape member are sewn together by one or more sewing threads.

In some instances, the fastener tape has a reinforcement film provided between the second tape region and the first side-edge portion.

In some instances, the flexible member and the fastener tape are coupled by two or more sewing threads, the two or more sewing threads includes a sewing thread that couples the first tape region, the flap, the second tape region, and a main portion of the flexible member.

Method according to an aspect of the present disclosure is a method of coupling a flexible member and a slide fastener, the slide fastener including: a pair of fastener stringers, each of the fastener stringers having a fastener tape provided with a first side-edge portion and a second side-edge portion which extend in an elongation direction of the fastener tape, and a fastener element provided on the first side-edge portion side; and one or more sliders for opening and closing the pair of fastener stringers, wherein the fastener tape includes a first tape region onto which a flap of the flexible member is to be overlaid and a second tape region positioned between the first tape region and the second side-edge portion, the method including: interposing the flap between the first tape region and the second tape region.

Method according to an aspect of the present disclosure is a method of producing a flexible member to which a slide fastener is coupled, the slide fastener including: a pair of fastener stringers, each of the fastener stringers having a fastener tape provided with a first side-edge portion and a second side-edge portion which extend in an elongation direction of the fastener tape, and a fastener element provided on the first side-edge portion side; and one or more sliders for opening and closing the pair of fastener stringers, wherein the fastener tape includes a first tape region onto which a flap of the flexible member is to be overlaid and a second tape region positioned between the first tape region and the second side-edge portion, the method including: interposing the flap between the first tape region and the second tape region.

Fastener tape according to an aspect of the present disclosure is a fastener tape configured by a plurality of warp threads and at least one weft thread, each warp thread extending in a lengthwise direction, the weft thread extending in a crosswise direction that is orthogonal to the lengthwise direction, and each warp thread extending to repeat crossing over the weft thread at a tape top surface side and crossing over the weft thread at a tape bottom surface side, the fastener tape including: a first tape region in which first portions of the weft thread are arranged at first pitch interval, the first portion being a portion crossed by the warp threads; a second tape region in which second portions of the weft thread are arranged at second pitch interval, the second portion being crossed by the warp threads and the second pitch interval being the same as the first pitch interval; and a third tape region positioned between the first tape region and the second tape region, wherein in the third tape region, no warp thread is provided, and third portions of the weft thread are arranged at third pitch interval that is equal to the first or second pitch interval, the third portion extending between the first and second portions of the weft thread.

In some instances, each of the first to third portions is a pair of weft-thread-portions adjacently arranged in the lengthwise direction, the pair of weft-thread-portions being included in the at least one weft thread.

In some instances, windows are formed between the third portions adjacently arranged in the lengthwise direction, each of the windows transversely elongated corresponding to an interspace between the first tape region and the second tape region, and a width of the window in the lengthwise direction is in accordance with a space required for the warp thread to pass through between the first portions or second portions of the weft thread which are adjacently arranged in the lengthwise direction.

In some instances, windows are formed between the third portions adjacently arranged in the lengthwise direction, each of the windows transversely elongated corresponding to an interspace between the first tape region and the second tape region, and a width of the window in the crosswise direction is greater than twice a width of the window in the lengthwise direction.

In some instances, the fastener tape further includes first and second side edge portions extending along the lengthwise direction. The first tape region is positioned closer to the first side-edge portion than the second side-edge portion, and the second tape region is positioned closer to the second side-edge portion than the first side-edge portion.

In some instances, the first tape region includes a first sub tape region adjacently arranged to the third tape region and a second sub tape region arranged closer to the first side-edge portion than the first sub tape region, and a structure of the first sub tape region differs from a structure of the second sub tape region.

In some instances, the warp threads and the weft thread are woven at a higher density in the first sub tape region compared to the second sub tape region.

In some instances, the first sub tape region is configured to have a 1/1 structure.

In some instances, the warp threads in the first sub tape region are thinner than the warp threads in the second sub tape region.

In some instances, the second tape region has a 1/1 structure.

In some instances, the second tape region includes a third sub tape region adjacently arranged to the third tape region and a fourth sub tape region arranged closer to the second side-edge portion than the third sub tape region, and a structure of the third sub tape region differs from a structure of the fourth sub tape region.

In some instances, the warp threads and the weft thread are woven at a higher density in the third sub tape region compared to the fourth sub tape region.

In some instances, the third sub tape region is configured to have a 1/1 structure.

In some instances, the warp threads in the third sub tape region are thinner than the warp threads in the fourth sub tape region.

Fastener stringer according to an aspect of the present disclosure includes: a fastener tape described above; and a fastener element arranged closer to the first side-edge portion of the fastener tape.

In some instances, the third tape region is arranged closer to the second side-edge portion than the first side-edge portion.

Slide fastener according to an aspect of the present disclosure includes: a pair of fastener stringers, each fastener stringer is as described above; and a slider for opening the pair of fastener stringers.

In some instances, an interspace between the fastener element and the third tape region in the crosswise direction is greater than a width of the second tape region in the crosswise direction.

Garment according to an aspect of the present disclosure includes; a slide fastener as described above; and a flexible member to which the slide fastener is sewn. The flexible member and the fastener tape are sewn such that a flap of the flexible member is interposed between the first tape region and the second tape region of the fastener tape.

In some instances, the flexible member and the fastener tape are sewn by at least two sewing threads extending in the lengthwise direction.

Method according to an aspect of the present disclosure is a method of producing a garment as described above in which the slide fastener is sewn to the flexible member, the method including: folding the fastener tape at the third tape region of the fastener tape; and sewing the flexible member and the fastener tape such that the flap of the flexible member is interposed between the first tape region and the second tape region of the fastener tape.

Advantageous Effects of Invention

According to an aspect of the present disclosure, a slide fastener or a fastener tape may be provided which may contribute in simplifying a sewing process.

DESCRIPTION OF EMBODIMENTS

Hereinafter, non-limiting embodiments of the present invention will be described with reference to FIGS. 1 to 26. A skilled person would be able to combine respective embodiments and/or respective features without requiring excess descriptions. Also, a skilled person would appreciate synergistic effects of such combinations. Overlapping descriptions among the embodiments would be basically omitted. Referenced drawings are mainly for describing inventions, and may possibly be simplified for the sake of convenience of illustration. Plural features described for one slide fastener, fastener tape or method may be understood as a combination of these features, but may be understood as individual features independent from other features. The individual feature would be clearly highlighted by a phrase of "In some cases". For example, individual features will be understood as universal features effective not only to illustrated slide fasteners or fastener tapes but also to other various slide fasteners or fastener tapes.

Figure 1:
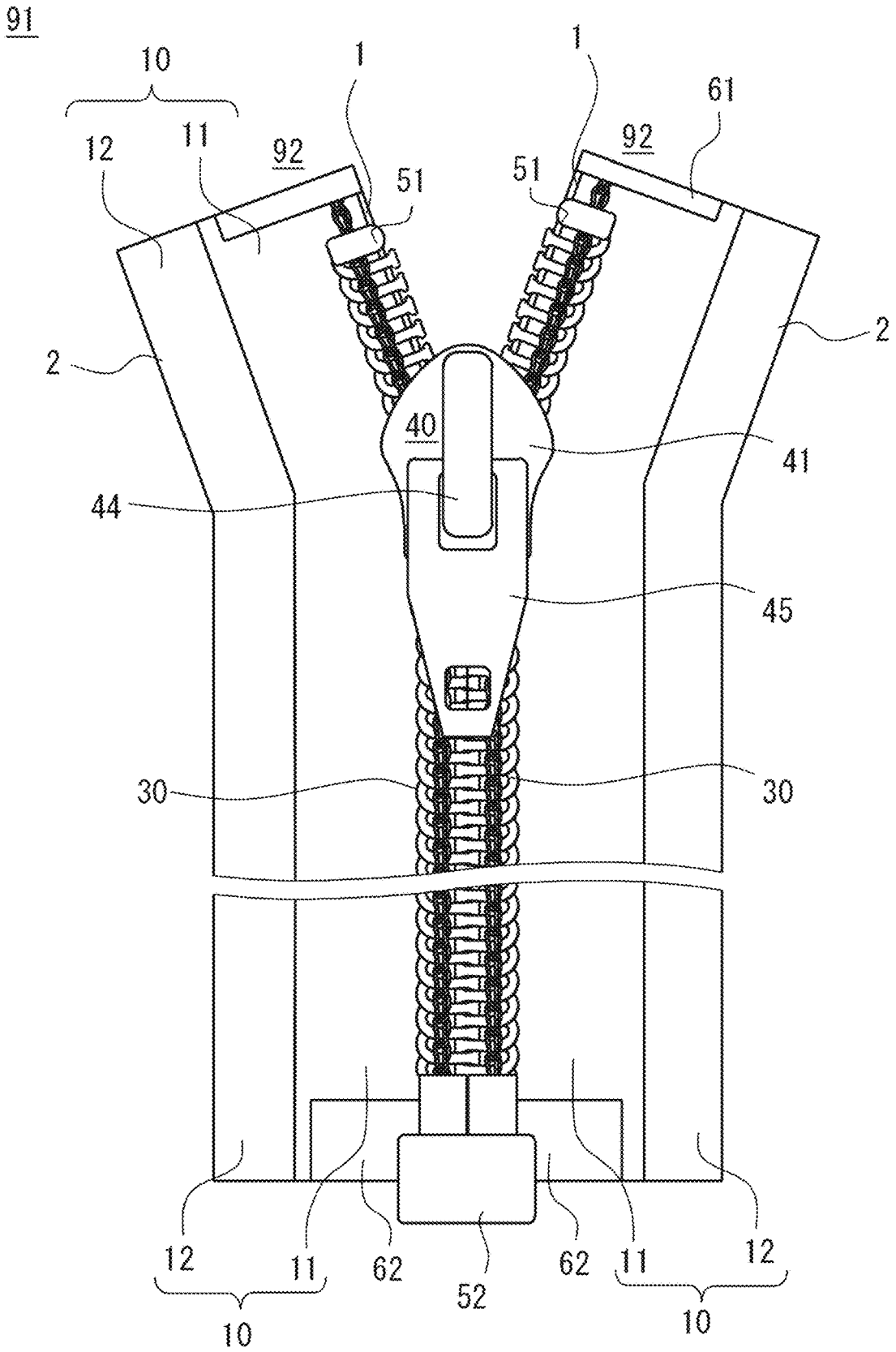
FIG. 1 is a schematic elevational view of a slide fastener according to an aspect of the present disclosure.

FIG. 1 is a schematic elevational view of a slide fastener 91. As would be understood from FIGS. 2-7, the slide fastener 91 will be coupled to a flexible member 100. The slide fastener 91 may be sewn to the flexible member 100, not necessarily limited to this though. The slide fastener 91 has a pair of left and right fastener stringers 92 and a slider 40 for opening and closing the paired left and right fastener stringers 92. Each fastener stringer 92 has a fastener tape 10 and a fastener element 30. The fastener tape 10 has first and second side-edge portions 1 and 2 extend in an elongation direction of the fastener tape 10. The width of the fastener tape 10 is defined by the first and second side-edge portions 1 and 2. The fastener element 30 is provided on the first side-edge portion 1 or at the first side-edge portion 1 side of the fastener tape 10. The elongation direction of the fastener tape 10 is the same as a moving direction of the slider 40. Embodiment is envisioned where a slide fastener is configured as a conceal-type slide fastener.

The pair of left and right fastener stringers 92 are closed by frontward movement of the slider 40 and are opened by rearward movement of the slider 40. Respective fastener elements 30 of fastener stringers 92 are engaged by frontward movement of the slider 40 and are disengaged by rearward movement of the slider 40. Front-rear direction would be understood based on the moving direction of the slider 40. Left-right direction would be understood from a direction in which the fastener stringer 92 are adjacently arranged. Up-Down direction is perpendicular to Front-Rear and Left-Right directions.

Figure 7:
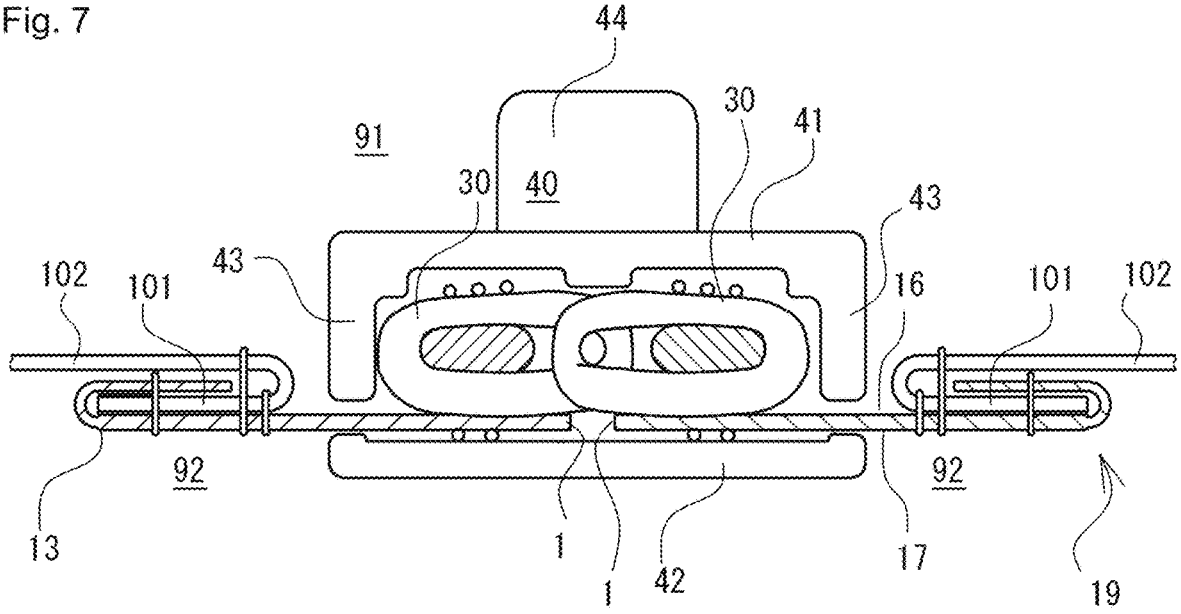
FIG. 7 is a schematic view of a slide fastener in which each fastener tape of the pair is sewn to a flexible member.

Slider 40 may be made of metal or resin. As shown in FIGS. 1 and 7, the slider 40 has a top wing 41, a bottom wing 42, a coupling pillar (not illustrated) extending along the up-down direction to couple the top and bottom wings 41 and 42, a pair of left and right flanges 43 extending along the up-down direction (downward in the illustration) from left and right side-edge portions of the top wing 41, a pull-attachment column 44, and a pull tab 45. The slider 40 has a pair of front mouths at the left and right sides of the coupling pillar, and a rear mouth at the opposite side. When the slider 40 moves rearward, left and right fastener elements 30 disengaged by the coupling pillar would move from inside to outside of the slider via the front mouths, respectively. Each fastener tape 10 of fastener stringer 92 passes through a slit extending in the front-rear direction between the flange 43 and the bottom wing 42 of the slider 40. Other types of sliders than the illustrated one may be employed as a slider 40.

The fastener tape 10 is elongated in a direction. When the fastener tape 10 is included in the slide fastener 91, the elongation direction of the fastener tape 10 matches the front-rear direction. The fastener tape 10 has first and second side-edge portions 1, 2 extending along the elongation direction. When the fastener tape 10 is included in the slide fastener 91, the first and second side-edge portions 1, 2 can be referred to as a pair of left and right side-edge portions. The fastener element 30 is arranged at the side of the first side-edge portion 1. The fastener tape 10 is a soft woven fabric with a (tape) top surface 16 and a (tape) bottom surface 17 opposite to the top surface 16.

In some cases, the fastener element 30 is a coil element formed by a monofilament helically wound along the front-rear direction. The coil element may be sewn to the fastener tape 10 by sewing thread(s) at a position at the side of the first side-edge portion 1. The fastener element 30 should not be limited to the coil element. Resin or metal elements can be employed as the fastener element 30. Resin or metal elements may be arranged at constant pitch in the elongation direction of the fastener tape 10.

In some cases, each fastener stringer 92 has at least one of a front stop 51, a first reinforcement film 61 and a second reinforcement film 62. The front stop 51 is a resin or metal part and is secured to the first side-edge portion 1 of the fastener tape 10 at a front-side terminal position relative to the fastener element 30. The front stop 51 prevents the frontward movement of the slider 40, i.e. defines a front-side stop position for the slider 40. The first reinforcement film 61 is a resin film for reinforcing the front end of the fastener tape 10. The second reinforcement film 62 is a resin film for reinforcing the rear end of the fastener tape 10. Each film 61, 62 is attached to the top surface 16 and/or the bottom surface 17 of the fastener tape 10. Each film 61, 62 may be attached to the fastener tape 10 through thermocompression bonding. In some cases, the slide fastener 91 further has a separable stop member 52 and the paired fastener stringers 92 are completely separable. In some cases, each film 61, 62 is provided between a second tape region 12 described below and the first side-edge portion 1. Each film 61, 62 is not overlaid onto the second tape region 12 so that softness of the second tape region 12 would be ensured.

Figure 2:
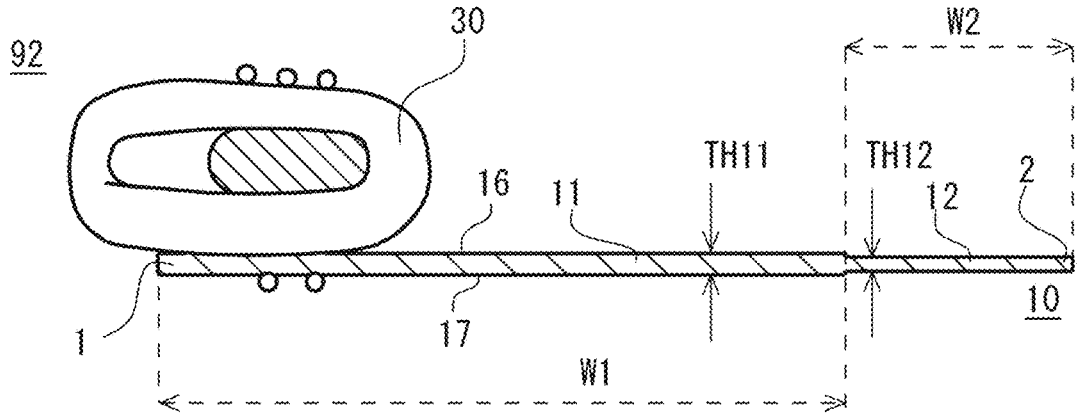
FIG. 2 is a schematic cross-sectional view of a fastener stringer according to an aspect of the present disclosure.
Figure 3:
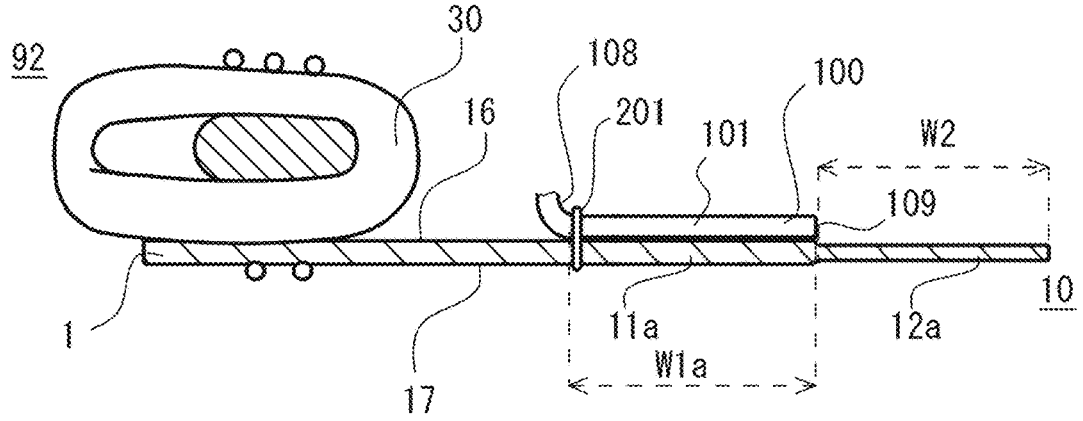
FIG. 3 is a schematic cross-sectional view of a fastener stringer according to an aspect of the present disclosure, illustrating that a flap of a flexible member is overlaid onto a first tape region of a fastener tape and the fastener tape is sewn to the flexible member by a sewing thread.
Figure 4:
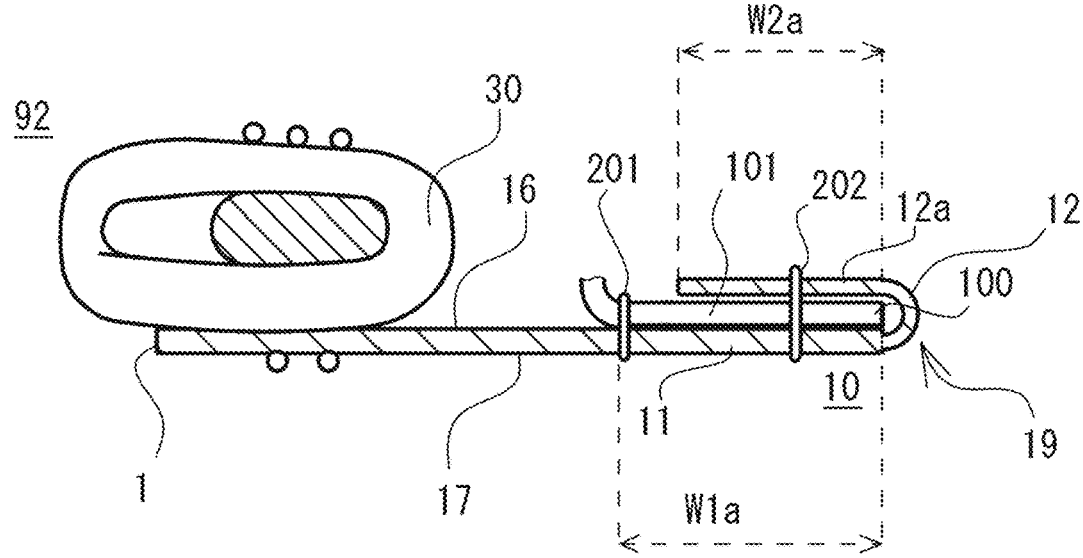
FIG. 4 is a schematic cross-sectional view of a fastener stringer according to an aspect of the present disclosure, illustrating that a second tape region is overlaid onto the flap of the flexible member which is placed onto the first tape region of the fastener tape, and these layers are sewn together by a sewing thread.
Figure 5:
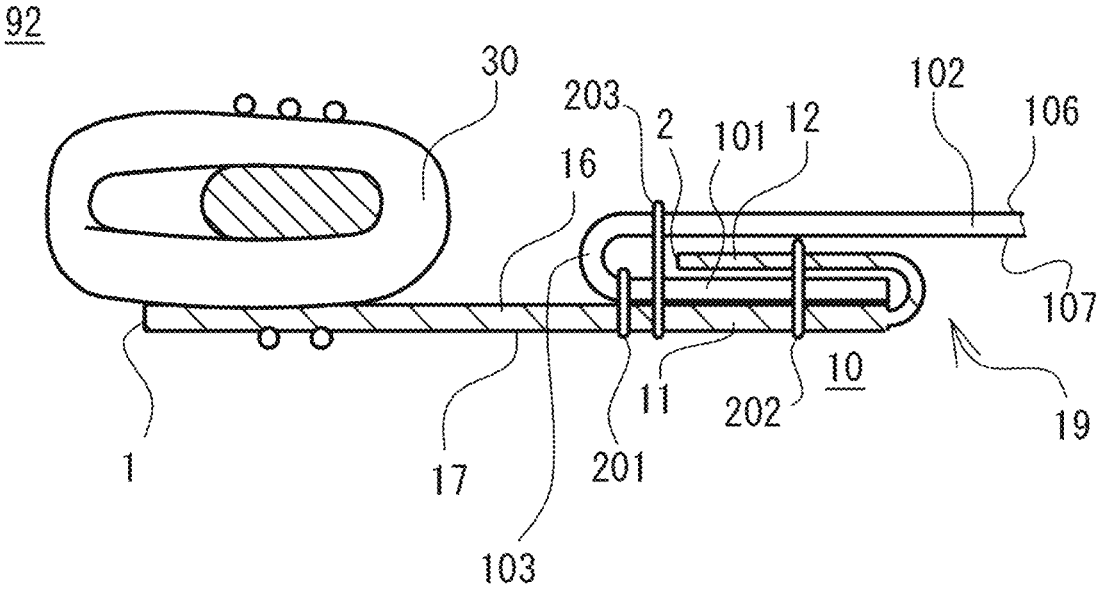
FIG. 5 is a schematic cross-sectional view of a fastener stringer according to an aspect of the present disclosure, illustrating that the first tape region, the flap, and the main portion are sewn together by a sewing thread.
Figure 6:
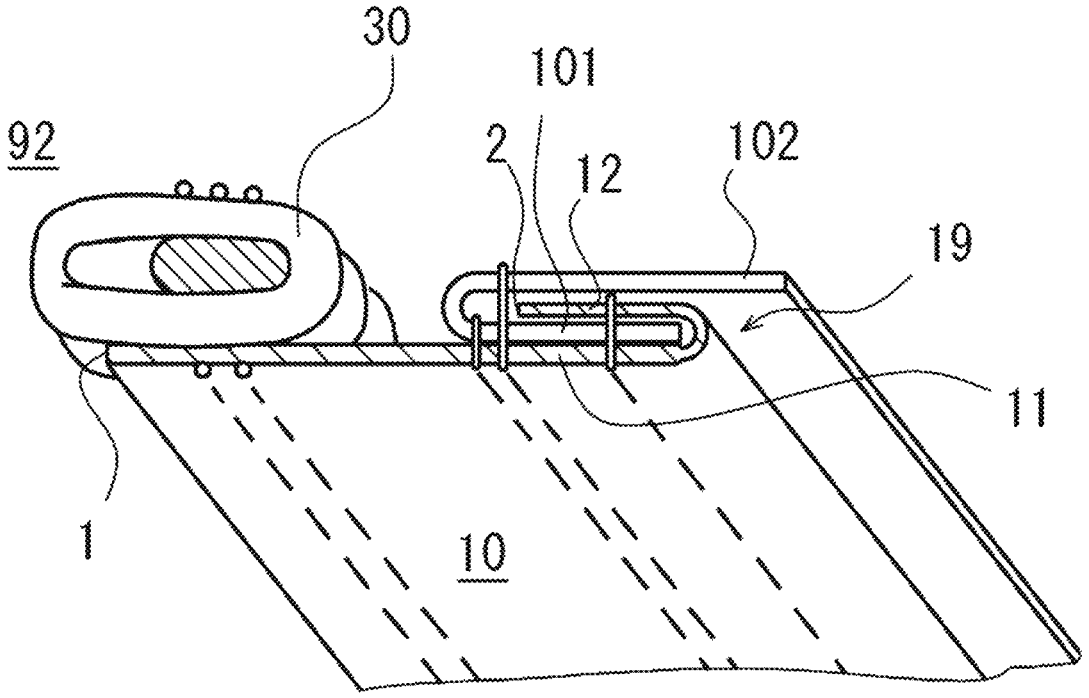
FIG. 6 is a schematic perspective partial view of a fastener stringer in which a fastener tape is sewn to a flexible member.

FIG. 2 is a schematic cross-sectional view of the fastener stringer 92. FIG. 3 is a schematic cross-sectional view of the fastener stringer 92, illustrating that the flap 101 of the flexible member 100 is overlaid onto a first tape region 11 of the fastener tape 10 and the fastener tape 10 is sewn to the flexible member 100 by a sewing thread 201. FIG. 4 is a schematic cross-sectional view of the fastener stringer 92, illustrating that the second tape region 12 is overlaid onto the flap 101 of the flexible member 100 which is placed onto the first tape region 11 of the fastener tape 10, and these layers are sewn together by a sewing thread. FIG. 5 is a schematic cross-sectional view of the fastener stringer 92, illustrating that the first tape region 11, the flap 101, and the main portion 102 are sewn together by a sewing thread. FIG. 6 is a schematic perspective partial view of the fastener stringer 92 in which the fastener tape 10 is sewn to the flexible member 100. FIG. 7 is a schematic view of the slide fastener 91 in which each fastener tape 10 of the pair is sewn to the flexible member 100.

As shown in FIG. 2, the fastener tape 10 has first and second tape regions 11 and 12. In other words, the fastener tape 10 can be divided into the first and second tape regions 11 and 12. The first tape region 11 is arranged at the side of the first side-edge portion 1, and the second tape region 12 is arranged at the side of the second side-edge portion 2. As described below, the thickness of each of the first and second tape region 11, 12 would be set appropriately. Note that, the fastener element 30 is placed onto the first tape region 11 at a position nearby the first side-edge portion 1 of the fastener tape 10, but not necessarily limited to this. The (transverse) width W2 of the second tape region 12 is equal to or less than the (transverse) width W1 of the first tape region 11, but not necessarily limited to this. The fastener tape 10 should be not limited to a single-layer base cloth, but an embodiment is envisioned where a laminated layer is formed onto the base cloth.

In some cases, the thickness TH11 of the first tape region 11 is equal to or greater than 0.3 mm and/or the width W1 of the first tape region 11 is equal to or greater than 6 mm. In contrast, the thickness TH12 of the second tape region 12 is within a range between 0.1-0.4 mm and/or the width W2 of the second tape region 12 is equal to or greater than 3 mm. Width W1 of the first tape region 11>Width W2 of the second tape region 12 may be satisfied.

Reduction of thickness TH11 of the first tape region 11 and/or thickness TH12 of the second tape region 12 results in reduction of thickness of an overlap region 11*a* (described below) of the first tape region 11 and/or thickness of an overlap region 12*a* (described below) of the second tape region 12. This may reduce penetration resistance applied when a needle penetrates through the fastener tape 10.

As shown in FIGS. 3-5, the slide fastener 91 may be sewn to the flexible member 100. Note that the flexible member 100 may be any material with flexibility such as a cloth, fabric, mesh material, natural leather, artificial leather, resin sheet, rubber sheet and metal sheet. Typically, the flexible member 100 is a part of garment and is included in a garment. The flexible member 100 has top and bottom surfaces 106 and 107 (See FIG. 5). The flexible member 100 has a flap 101 and a main portion 102, and has a U-shaped or V-shaped turn 103 between the flap 101 and the main portion 102. The flap 101 is a folded portion over the main portion 102 such that the flap 101 has the bottom surface 107 opposed to the bottom surface 107 of the main portion 102.

As shown in FIG. 3, the flap 101 of the flexible member 100 is overlaid onto the first tape region 11 of the fastener tape 10. The flap 101 and the first tape region 11 are coupled by coupling means such as sewing thread(s) or an adhesive layer (e.g. double-sided tape) or thermocompression bonding. Preferably, the flap 101 and the first tape region 11 are sewn together by the sewing thread 201. Accordingly, relative position between the flexible member 100 and the fastener stringer 92 are fixed. In some cases, the side-edge portion 109 of the flexible member 100 is positioned adjacent to a boundary between the first and second tape regions 11 and 12. It is envisioned that, in accordance with material of the flexible member 100 or error when sewing, the side-edge portion 109 of the flexible member 100 can be placed in a position shifted toward the first or second side-edge portion 1 or 2 of the fastener tape 10.

The first tape region 11 has an overlap region 11*a* onto which the flap 101 is overlaid. The (transverse) width W1*a* of the overlap region 11*a* matches or corresponds to a contact region between the first tape region 11 and the flap 101 of the flexible member 100. In some cases, the (transverse) width W1*a* of the overlap region 11*a* is greater than the (transverse) width W2 of the second tape region 12.

The second tape region 12 is positioned between the first tape region 11 and the second side-edge portion 2. The second tape region 12 has an overlap region 12*a* that is overlaid onto the flap 101. The overlap region 11*a* in the first tape region 11 may be referred to as a first overlap region, and the overlap region 12*a* in the second tape region 12 may be referred to as a second overlap region. In some cases, the (transverse) width W2*a* of the overlap region 12*a* is equal to or less than the (transverse) width W1*a* of the overlap region 11*a*.

As shown in FIG. 4, the second tape region 12 of the fastener tape 10 is folded over the first tape region 11 so that the overlap region 12*a* of the second tape region 12 is overlaid onto the flap 101 of the flexible member 100 that is placed on the overlap region 11*a* of the first tape region 11. The flap 101 of the flexible member 100 is interposed between the first tape region 11 (the overlap region 11*a*) and the second tape region 12 (the overlap region 12*a*). The side-edge portion 109 of the flexible member 100 is covered by the fastener tape 10 so that its exposure is prevented. The flap 101 and the second tape region 12 are coupled by coupling means such as sewing thread(s) or an adhesive layer (e.g. double-sided tape) or thermocompression bonding. Preferably, the first tape region 11, the flap 101, and the second tape region 12 are sewn together by the sewing thread 202, thus more surely preventing the exposure of the side-edge portion 109 of the flexible member 100 when being laundered.

The fastener tape 10 is folded at a boundary between the first and second tape regions 11 and 12 so that the covering portion 19 is formed. The covering portion 19 is a turn formed in the fastener tape 10. The side-edge portion 109 of the flexible member 100 is covered by the covering portion 19 of the fastener tape 10 thus its exposure is prevented. In some cases, the second tape region 12 is overlaid onto the flap 101 of the flexible member 100 such that the second side-edge portion 2 of the fastener tape 10 does not reach the sewing thread 201, not necessarily limited to this though.

Finally, as shown in FIG. 5, the first tape region 11 of the fastener tape 10, the flap 101 of the flexible member 100, and the main portion 102 of the flexible member 100 are sewn together by a sewing thread 203. The sewing thread 203 extends along the elongation direction of the fastener tape 10 and forms a stitch line on the top surface 106 of the flexible member 100.

Sewing for the flexible member 100 and the fastener tape 10 can be done manually or using existing or tailored sewing machine. The flexible member 100 and the fastener tape 10 are suitably overlaid and sewn together manually. In a case where a sewing machine is used, a guide member may be used to guide the fastener stringer 92 to a needle position. Likewise, a guide member may be used to guide the flexible member 100 to the needle position.

The second tape region 12 may have a thickness that differs from a thickness of the first tape region 11 (See FIG. 2). In some cases, the second tape region 12 has a thickness TH12 that is lesser than a thickness Th11 of the first tape region 11 (See FIG. 2). That is, the second tape region 12 is thinner than the first tape region 11. Setting a difference between the thickness TH11 of the first tape region 11 and the thickness TH12 of the second tape region 12 allows easier folding of the fastener tape 10 along the boundary between the first and second tape regions 11 and 12. Various methods can be used to set a difference between the thickness TH11 of the first tape region 11 and the thickness TH12 of the second tape region 12. For example, warp threads with different thickness can be used to set a difference between the thickness TH11 of the first tape region 11 and the thickness TH12 of the second tape region 12. Structure can be different between the first and second tape regions 11 and 12 to set a difference between the thickness TH11 of the first tape region 11 and the thickness TH12 of the second tape region 12. Warp thread 4 may be different between the first and second tape regions 11 and 12 to set a difference between the thickness TH11 of the first tape region 11 and the thickness TH12 of the second tape region 12. The warp thread 4 may be a multi-filament (strand) of bundled plural filaments. For example, a single filament of the warp thread 4 in the second tape region 12 is thinner than a single filament of the warp thread 4 in the first tape region 11. In other words, the second tape region 12 includes a warp thread 4 consisting of thinner filaments than filaments of the warp thread 4 in the first tape region 11. One or more laminated layer may be formed onto the tape base cloth to increase the thickness of the fastener tape 10. Other methods would be adoptable.

In embodiments where the warp threads 4 in the first tape region 11 differ from the warp threads 4 in the second tape region 12, there may be a difference in softness between the warp threads 4 in the first tape region 11 and the warp threads 4 in the second tape region 12. Embodiments are envisioned where there is no difference between the thickness TH11 in the first tape region 11 and the thickness TH12 in the second tape region 12, even though the warp threads 4 in the first tape region 11 differ from the warp threads 4 in the second tape region 12.

In some cases, the first tape region 11 includes a warp thread 4 made of M (M indicates a natural number equal to or greater than 2) filaments, and the second tape region 12 includes a warp thread 4 made of N (N indicates a natural number equal to or greater than 2) filaments. N may be less than M and/or a filament of the warp thread 4 in the second tape region 12 may be thinner than a filament of the warp thread 4 in the first tape region 11. This facilitates to allow the second tape region 12 to have higher softness. Note that, the thickness of filament (fiber diameter) can be expressed by decitex, for example.

Figure 8:
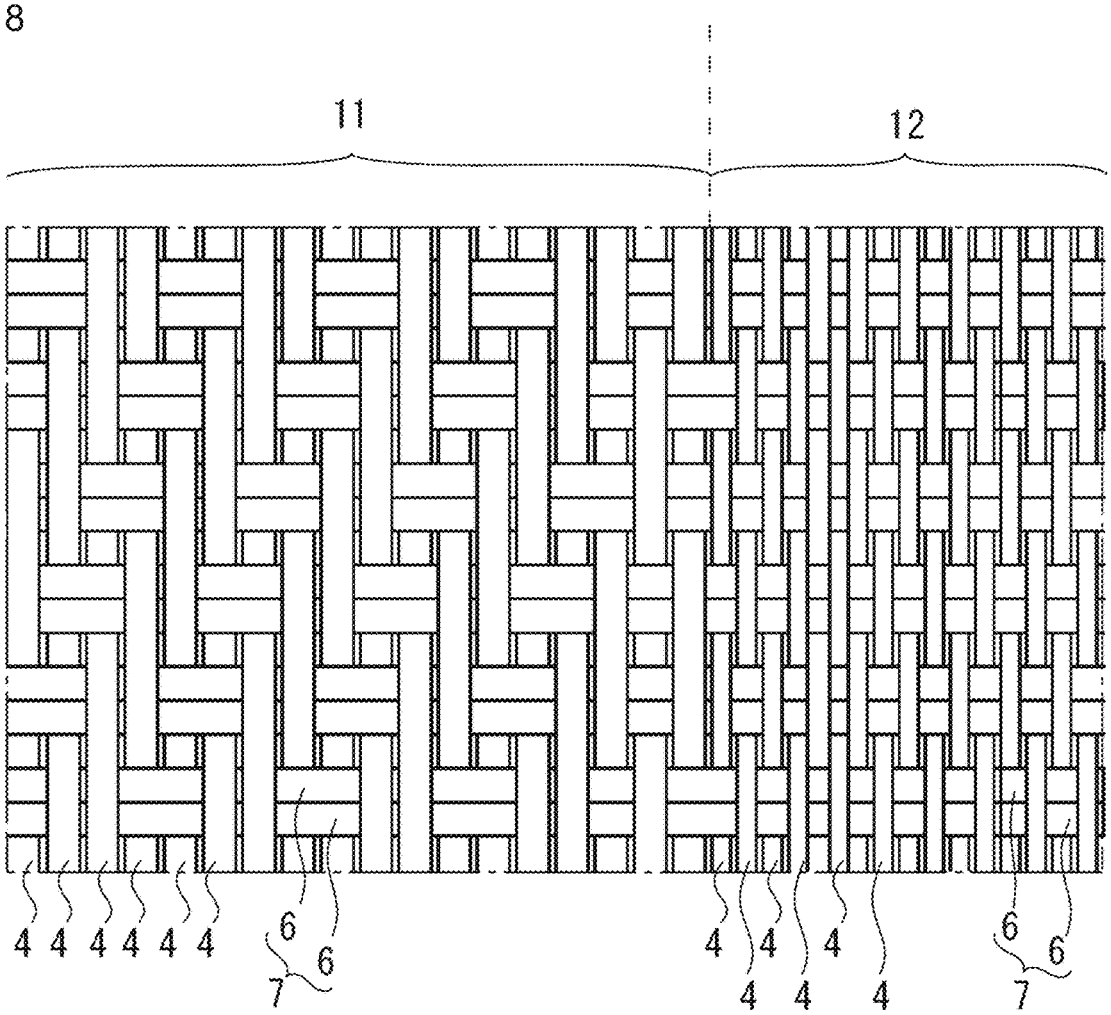
FIG. 8 is a schematic view illustrating a structure of a fastener tape.

FIG. 8 is a schematic view illustrating a structure of the fastener tape 10. The fastener tape 10 is configured by a plurality of warp threads 4 each extending in the lengthwise direction and at least one weft thread 6 extending in the crosswise direction orthogonal to the lengthwise direction. Each warp thread 4 extends to repeat crossing the weft thread 6 at the top surface 16 side and crossing the weft thread 6 at the bottom surface 17 side. A portion of the warp thread 4 provided above the weft thread 6 may be referred to as a "float portion", and a portion of the warp thread 4 provided beneath the weft thread 6 may be referred to as a "sunk portion". Each warp thread 4 is made of alternate continuation of the float and sink portions. Weft thread 6 is commonly used across the first and second tape regions 11 and 12.

As shown in FIG. 8, the first tape region 11 has a twill-woven structure and the second tape region 12 has a plain-woven structure. This facilitates the thickness TH12 of the second tape region 12 be thinner than the thickness TH11 of the first tape region 11 (See FIG. 2). In the plain-woven structure, the weft threads 6 are bound by the warp thread 4 at a higher density so that the tape thickness is reduced.

As shown in FIG. 8, the second tape region 12 includes warp threads 4 thinner than the warp threads 4 in the first tape region 11. In particular, the second tape region 12 is configured by warp threads 4 that are thinner than the warp threads 4 in the first tape region 11. The second tape region 12 is configured by the warp threads 4 thinner than the warp threads 4 in the first tape region 11 so that the thickness TH12 of the second tape region 12 is set lesser than the thickness TH11 of the first tape region 11 (See FIG. 2). Embodiments are envisioned where the second tape region 12 includes the warp threads 4 thicker than the warp threads 4 in the first tape region 11, and the thickness TH12 of the second tape region 12 is greater than the thickness TH11 of the first tape region 11.

The fastener tape 10 shown in FIG. 8 can be produced using existing looms. Embodiments are envisioned where the fastener element 30 made of monofilament is incorporated into the structure at the fastener tape 10. In other words, the fastener element 30 should not be limited to an embodiment where it is sewn to the fastener tape 10 by sewing threads as depicted.

In the present embodiment, the fastener tape 10 itself is used to prevent exposure of the side-edge portion 109 of the flexible member 100. Unlike the manner shown in FIG. 26, if the bias tape 900 is not used, maintenance burden or material cost for the bias tape 900 would be fundamentally solved. Operation burden in sewing processes would be reduced compared to a case where the bias tape 900 is used.

Figure 9:
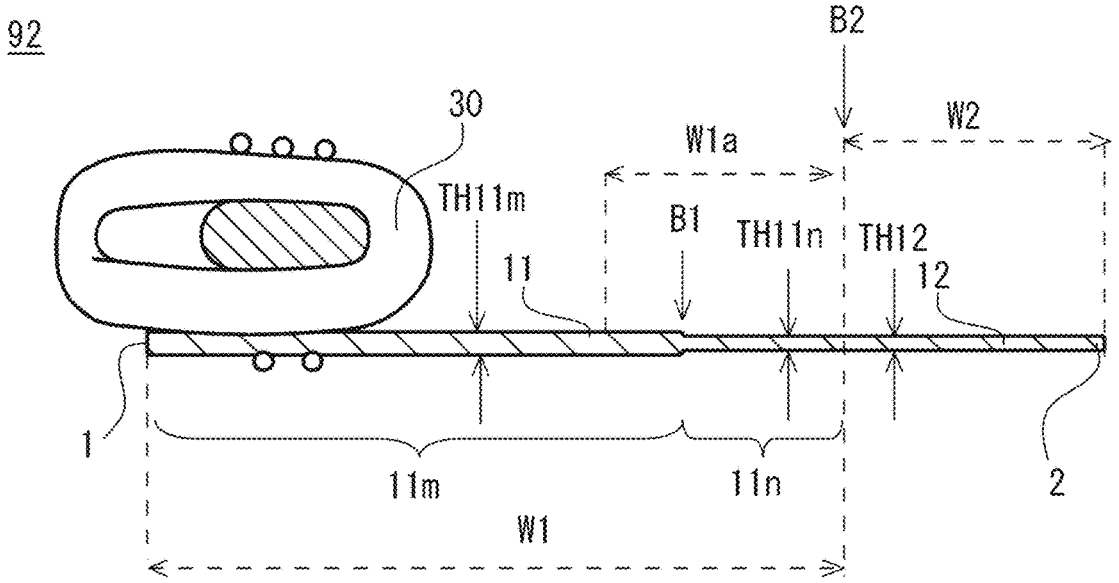
FIG. 9 is a schematic cross-sectional view of a fastener stringer in which a boundary regarding a difference in tape thickness in a fastener tape is positioned at an intermediate position between a fastener element and a boundary of the first and second tape regions.
Figure 10:
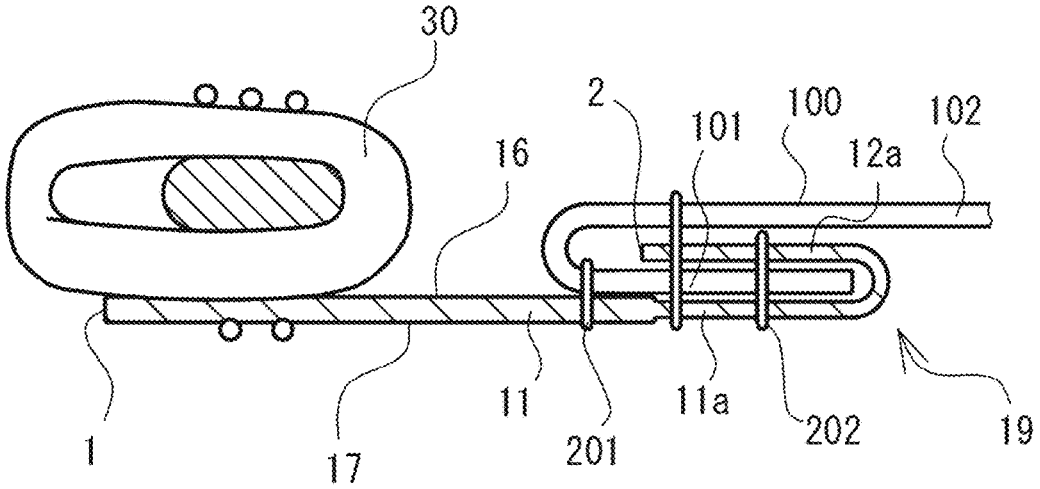
FIG. 10 is a schematic view illustrating that a fastener tape of a fastener stringer shown in FIG. 9 and a flexible member are sewn together by sewing threads.

FIG. 9 is a schematic cross-sectional view of the fastener stringer 92 in which the boundary regarding the difference in tape thickness in the fastener tape 10 is positioned at an intermediate position between the boundary of the first and second tape regions 11 and 12 and the fastener element 30. FIG. 10 is the schematic view illustrating that the fastener tape 10 of the fastener stringer 92 shown in FIG. 9 and the flexible member 100 are sewn together by sewing threads. In some cases, the boundary B1 regarding the difference in tape thickness of the fastener tape 10 is positioned at an intermediate position between the boundary B2 of the first and second tape regions 11 and 12 and the fastener element 30. Even in such a case, the side-edge portion 109 of the flexible member 100 can be covered by the fastener tape 10.

In more detail, the first tape region 11 has a sub tape region 11*m* having a first thickness TH11*m* and a sub tape region 11*n* having a second thickness TH11*n*. TH11*m*>TH11*n* is satisfied. The thickness of the second tape region 12 is equal to the second thickness TH11*n* of the sub tape region 11*n* in the first tape region 11. The second tape region 12 is thinner than a part of the first tape region 11, particularly than the sub tape region 11*m*. The boundary B1 regarding a difference in tape thickness of the fastener tape 10 is set at a boundary between the sub tape region 11*m* and the sub tape region 11*n*. The boundary B1 is positioned in the intermediate position between the fastener element 30 and the boundary B2 of the first and second tape regions 11 and 12, and is positioned in the extent of the overlap region 11*a*.

The fastener tape 10 is folded such that the second tape region 12 is placed on to the above-described flap 101 so that exposure of the side-edge portion 109 of the flexible member 100 is prevented. The flap 101 of the flexible member 100 is interposed between the sub tape region 11*n* and the second tape region 12 which have lesser thicknesses compared with the sub tape region 11*m*. Total thickness of the sub tape region 11*n*, the flap 101, and the second tape region 12 is reduced, and penetration resistance applied to a sewing needle is reduced.

Figure 11:
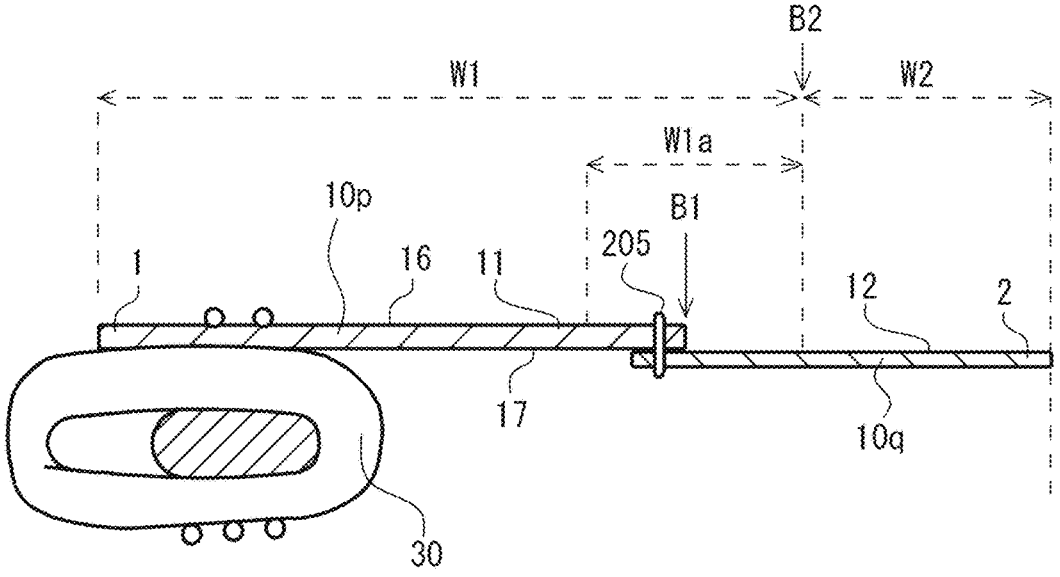
FIG. 11 is a schematic view illustrating a case where a fastener tape is configured by first and second tape members. Boundary regarding a difference in tape thickness of a fastener tape is positioned at an intermediate position between a fastener element and a boundary of first and second tape regions.
Figure 12:
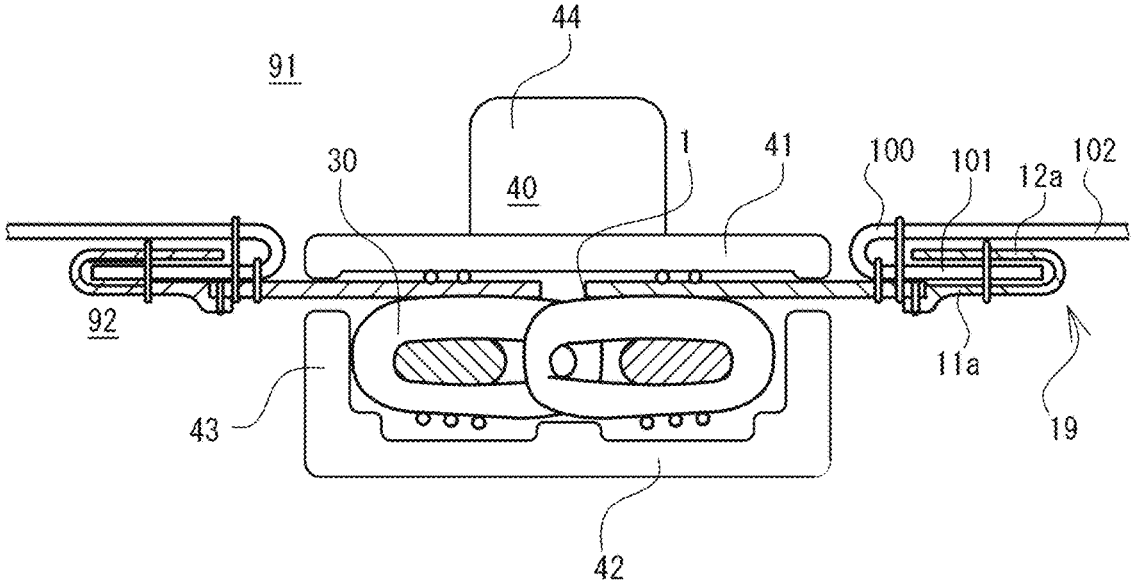
FIG. 12 is a schematic view of a slide fastener including a fastener stringer shown in FIG. 11.

FIG. 11 is a schematic view illustrating a case where the fastener tape 10 is configured by first and second tape members 10*p* and 10*q*. Boundary B1 regarding a difference in tape thickness of the fastener tape 10 is positioned at an intermediate position between the fastener element 30 and the boundary B2 of the first and second tape regions 11 and 12. FIG. 12 is a schematic view of a slide fastener including a fastener stringer shown in FIG. 11.

As shown in FIG. 11, the fastener tape 10 includes first and second tape members 10*p* and 10*q*, and the side-edge portion of the first tape member 10*p* and the side-edge portion of the second tape member 10*q* are overlapped. The first and second tape members 10*p* and 10*q* are coupled by coupling means such as sewing thread(s) or an adhesive layer (e.g. double-sided tape) or thermocompression bonding. Preferably, the first tape member 10*p* and the second tape member 10*q* are sewn together by one or more sewing threads 205. The boundary B1 regarding the difference in tape thickness of the fastener tape 10 is set at a coupled position of the first tape member 10*p* and the second tape region 12. The boundary B1 is positioned at an intermediate position between the fastener element 30 and a boundary B2 of the first and second tape regions 11 and 12. The boundary B1 is positioned within the extent of the overlap region 11*a*, not necessarily limited to this though.

The fastener element 30 is provided onto the bottom surface 17 of the fastener tape 10 (the bottom surface 17 of the first tape member 10*p*). It is envisioned that the fastener element 30 is provided onto the top surface 16 of the fastener tape 10 or incorporated into the structure of the fastener tape 10. In some cases, the thickness of the second tape member 10*q* is lesser than the thickness of the first tape member 10*p*. That is, the second tape region 12 is thinner than the first tape region 11. Functionality as a base cloth of the fastener tape 10 may be allocated to the first tape member 10*p*, and functionality for coving the side-edge portion 109 of the flexible member 100 may be allocated to the second tape member 10*q*. In order to achieve a target withstand strength when the slide fastener 91 is pulled crosswise, the first tape member 10*p* may have harder structure, and the second tape member 10*q* may have more flexible structure or material. In cases where the fastener tape 10 is configured from the first and second tape members 10*p* and 10*q*, the fastener tape 10 can be wider without restricted by existing looms to a given possible (crosswise) width of the fastener tape 10.

In some cases, the second tape member 10*q* is a bias tape. Use of the bias tape as the second tape member 10*q* ensures higher flexibility and facilitates lighter weight. Commercially available bias tapes can be used.

Figure 13:
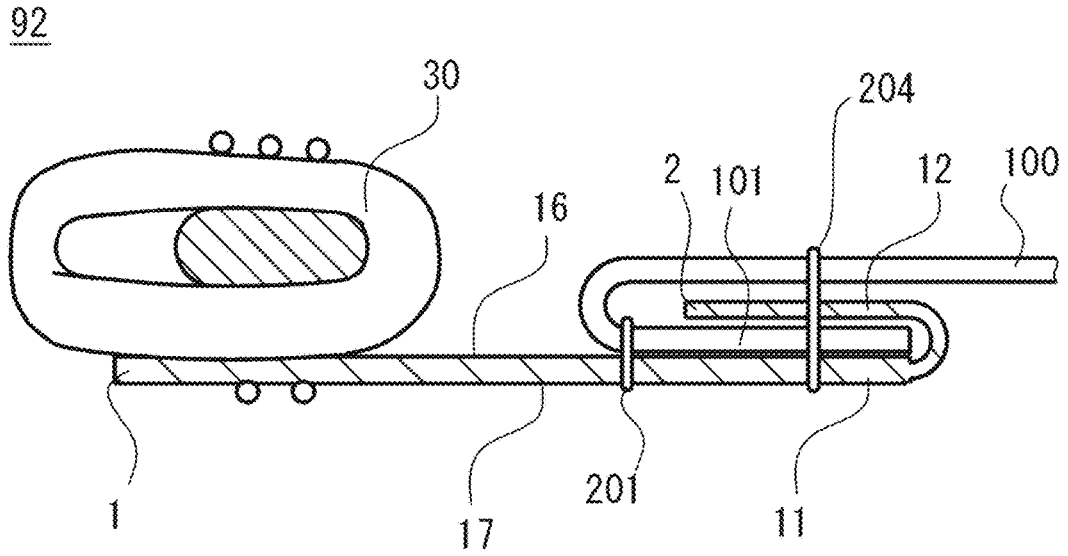
FIG. 13 is a schematic view illustrating an embodiment in which a fastener tape is sewn to a flexible member by two sewing threads.

FIG. 13 is a schematic view illustrating an embodiment in which a fastener tape 10 is sewn to a flexible member 100 by two sewing threads 201, 204. As shown in FIG. 13, sewing threads for coupling the flexible member 100 and the fastener tape 10 include a sewing thread 204 that couples the first tape region 11 (the overlap region 11*a*), the flap 101, the second tape region 12 (the second overlap region 12*a*), and the main portion 102 of the flexible member 100. The number of sewing threads is reduced compared with a case of FIG. 5, facilitating reduction of time required for sewing.

Figure 26:
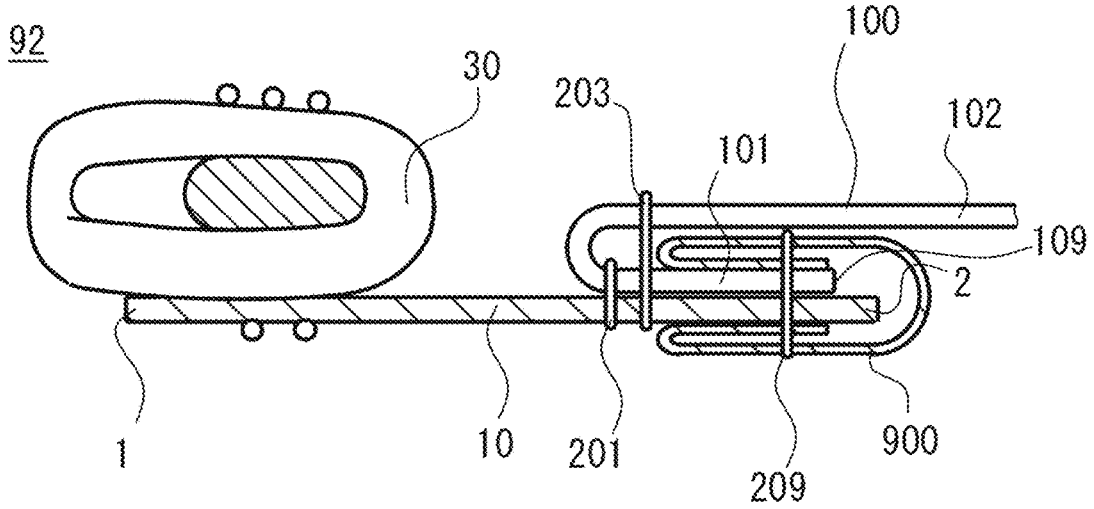
FIG. 26 is a reference diagram illustrating that a bias tape is used for sewing a fastener tape and a flexible member.

In cases where the side-edge portion 109 of the flexible member 100 is covered by the fastener tape 10, there is no need to sew the bias tape 900 to the fastener tape 10 as shown in FIG. 26. Therefore, as shown in FIG. 13, the fastener tape 10 and the flexible member 100 can be sewn together by the two sewing threads 201, 204.

Figure 14:
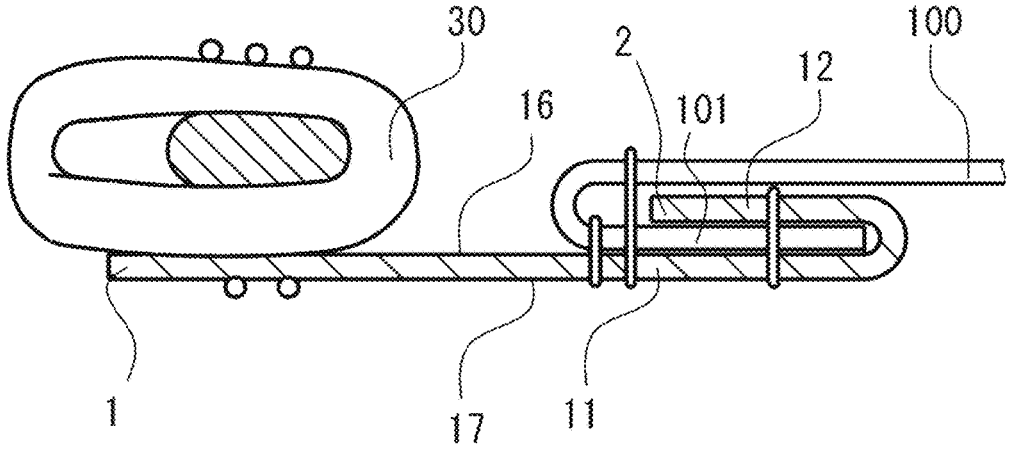
FIG. 14 is a schematic view illustrating a case where a fastener tape having a constant thickness is used.

FIG. 14 is a schematic view illustrating a case where a fastener tape 10 having a constant thickness is used. In cases where the fastener tape 10 with constant thickness is used, the side-edge portion 109 of the flexible member 100 can be covered by the fastener tape 10. It is not necessary that the thickness of the second tape region 12 is less than the thickness of the first tape region 11.

Figure 15:
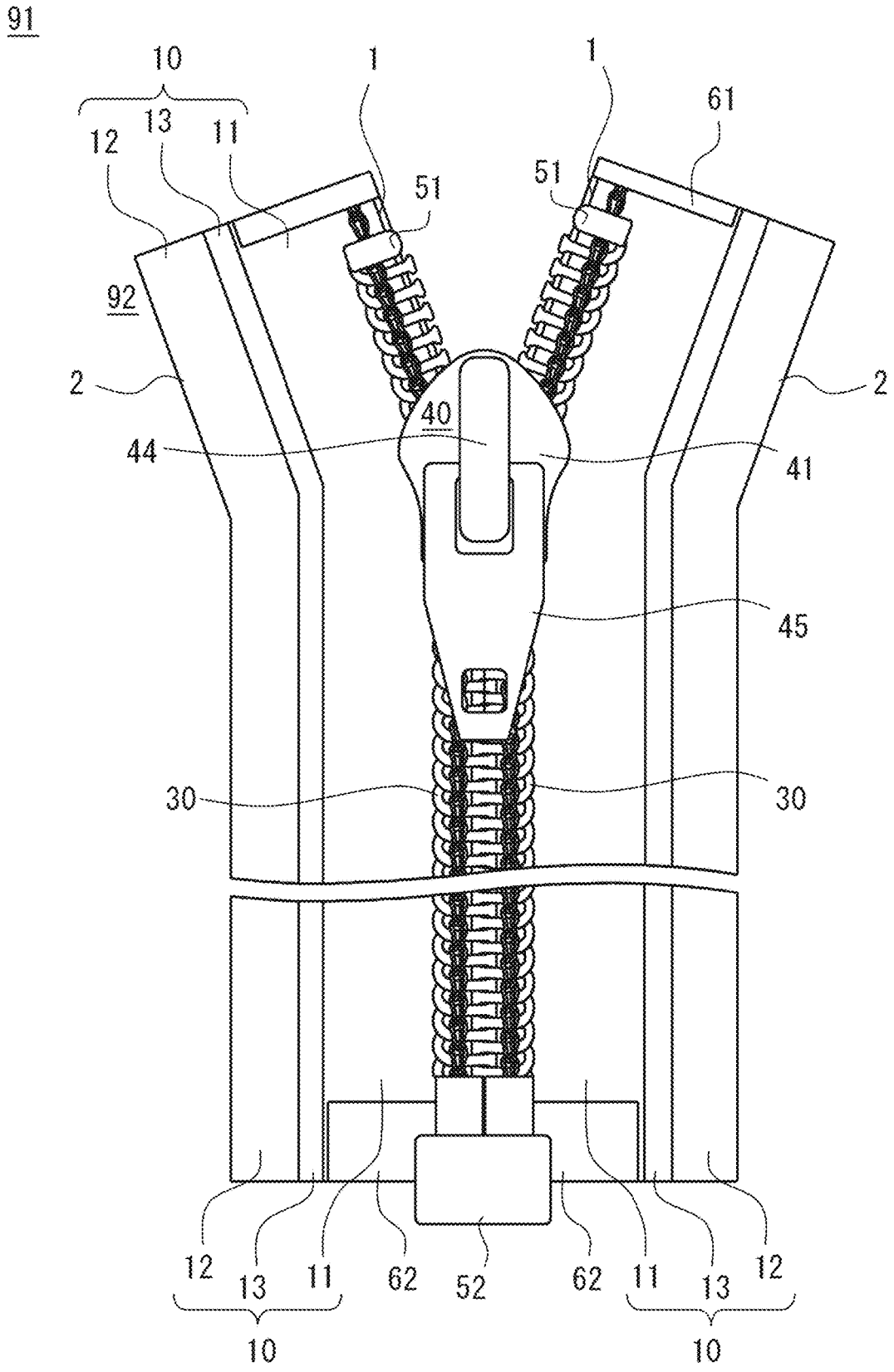
FIG. 15 is a schematic top view of a slide fastener according to the present disclosure.
Figure 16:
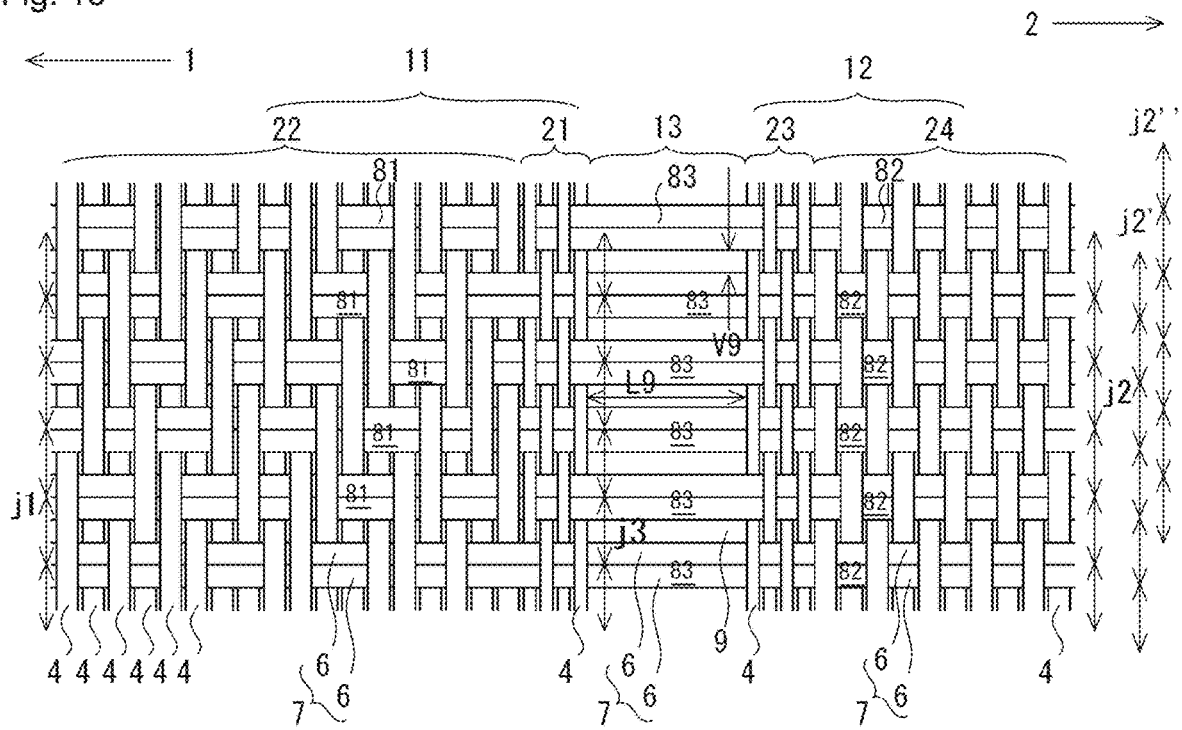
FIG. 16 is schematic view illustrating a schematic exemplary tape structure at top or bottom surface of fastener tape according to the present disclosure.
Figure 17:
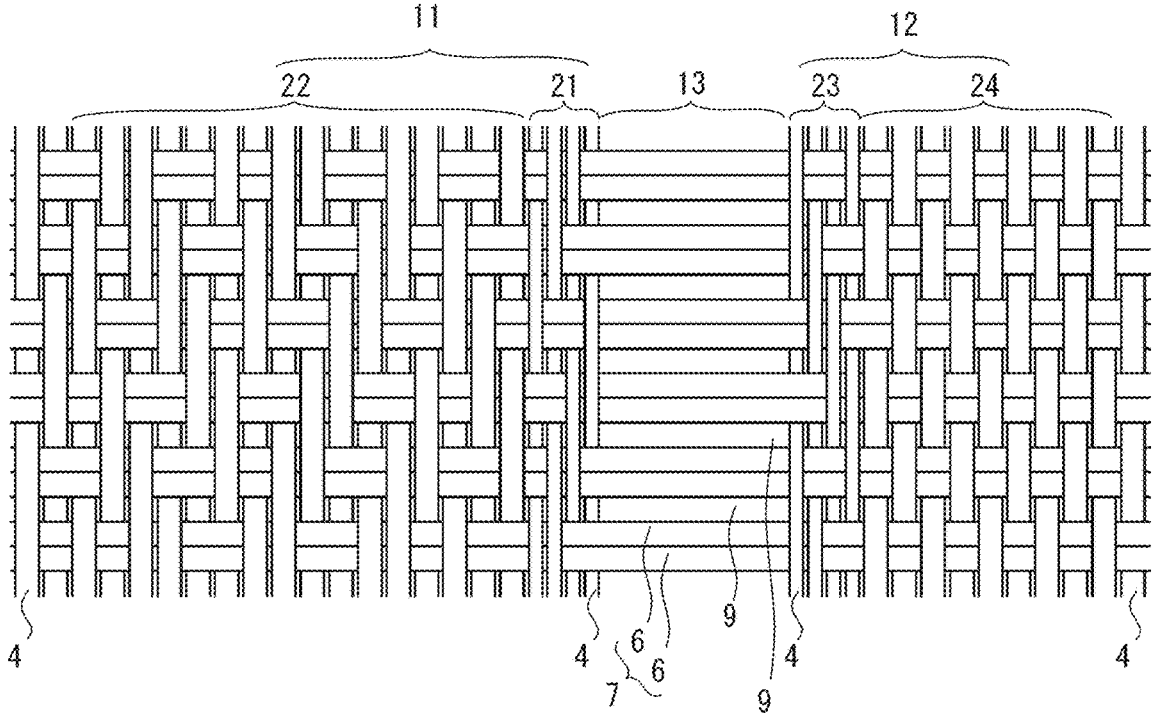
FIG. 17 is a schematic view illustrating another schematic tape structure at top or bottom surface of fastener tape according to the present disclosure.
Figure 18:
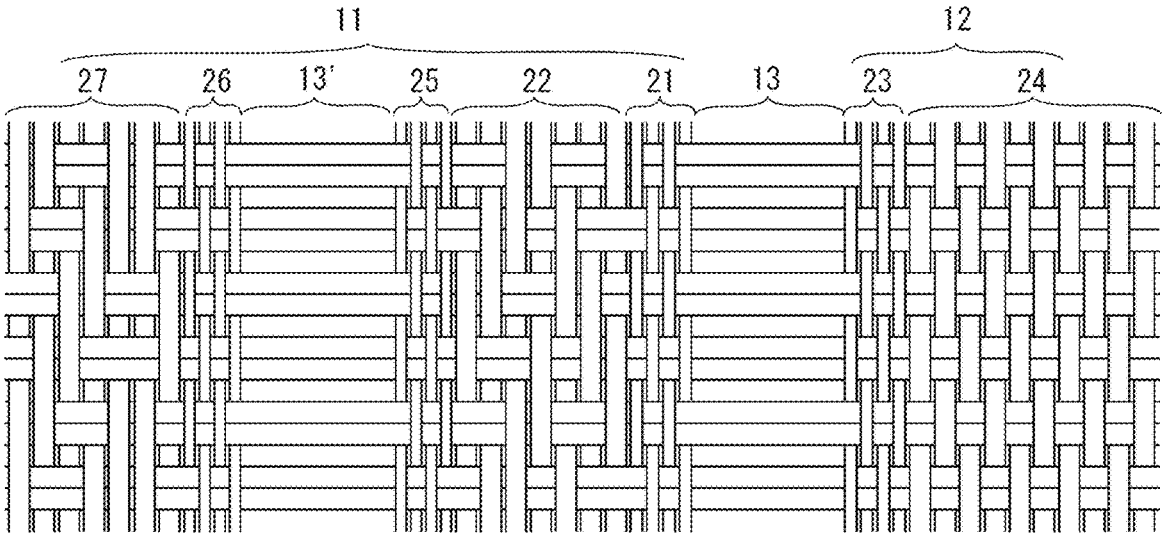
FIG. 18 is a schematic view illustrating yet another schematic tape structure at top or bottom surface of fastener tape according to the present disclosure.
Figure 19:
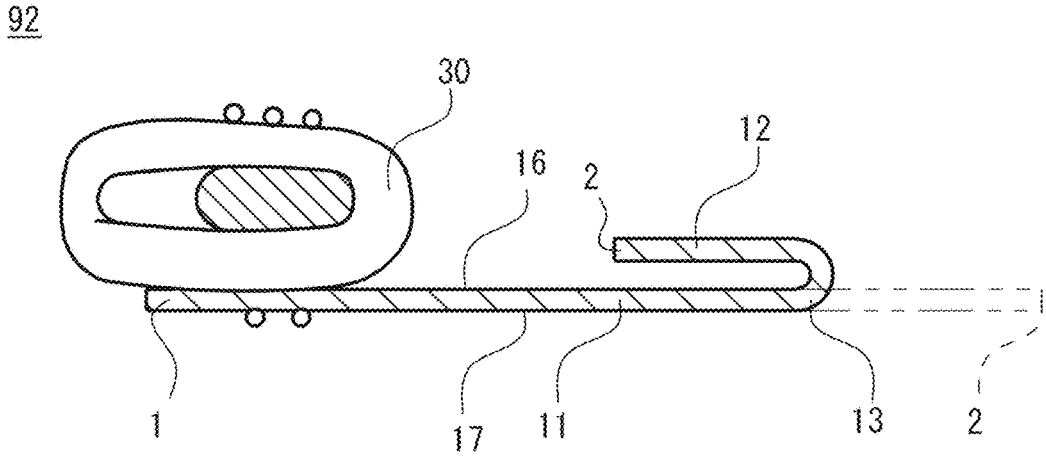
FIG. 19 is a schematic cross-sectional view of a fastener stringer according to the present disclosure, schematically illustrating that a fastener tape is folded at a third tape region to form a covering portion.
Figure 20:
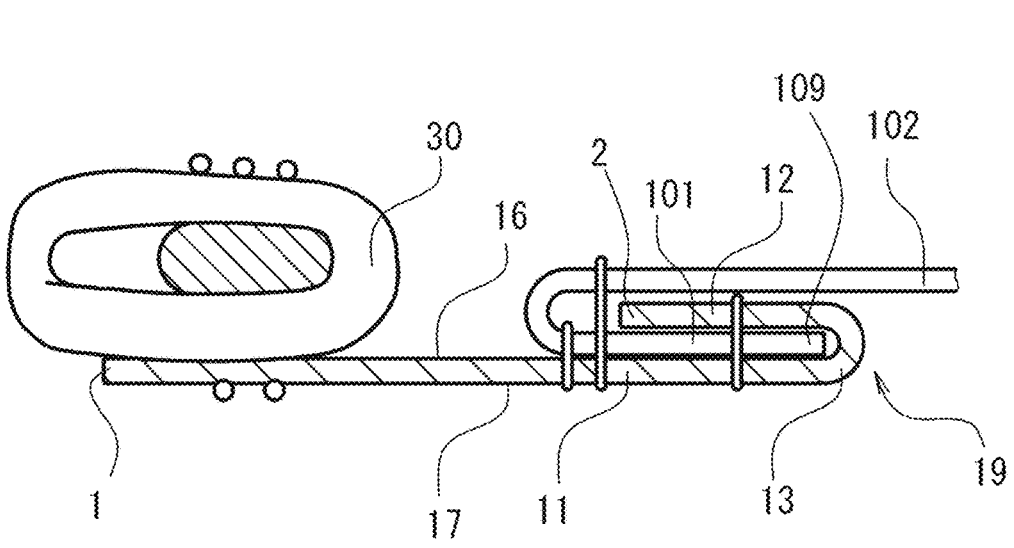
FIG. 20 is a schematic view illustrating that a fastener tape of a fastener stringer of the present disclosure is sewn to a flexible member, where a flap of the flexible member is interposed between first and second tape regions.
Figure 21:
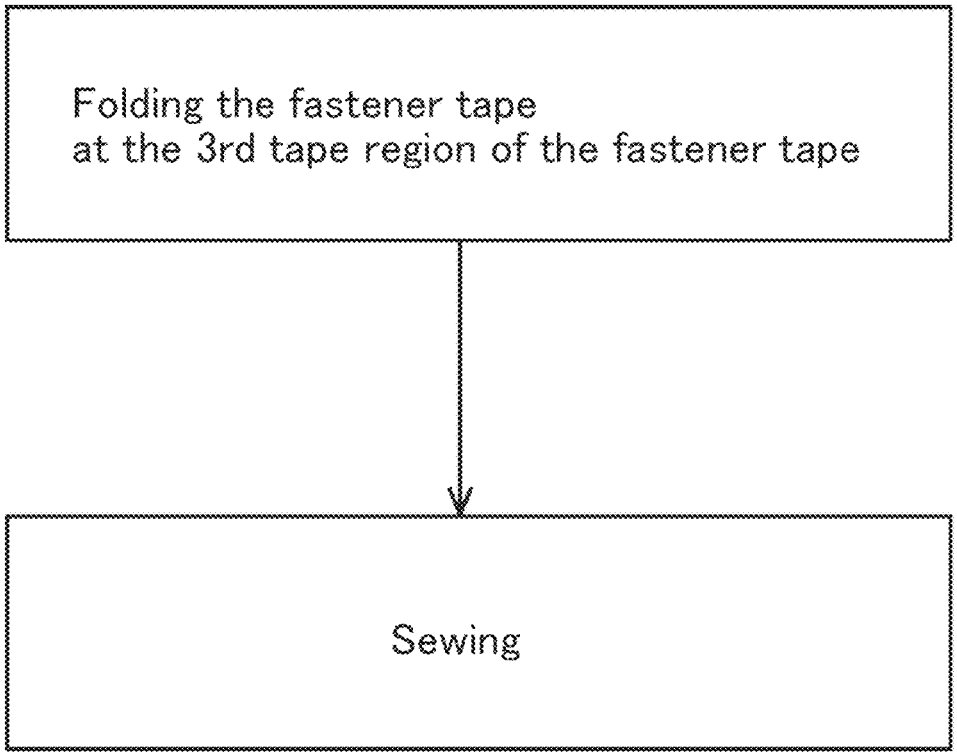
FIG. 21 is a schematic flowchart of a method of sewing according to the present disclosure.

Hereinafter various embodiments will be described with reference to FIGS. 15-21, focusing on the fastener tape 10. FIG. 15 is a schematic top view of a slide fastener 91. FIG. 16 is schematic view illustrating a schematic exemplary tape structure at top or bottom surface of fastener tape 10. FIG. 17 is a schematic view illustrating another schematic tape structure at top or bottom surface of fastener tape 10. FIG. 18 is a schematic view illustrating yet another schematic tape structure at top or bottom surface of fastener tape 10. FIG. 19 is a schematic cross-sectional view of a fastener stringer 92, schematically illustrating that a fastener tape is folded at a third tape region 13 to form a covering portion 19. FIG. 20 is a schematic view illustrating that a fastener tape 10 of a fastener stringer 92 is sewn to a flexible member 100, a flap of the flexible member be interposed between first and second tape regions. FIG. 21 is a schematic flowchart of a method of sewing.

As schematically shown in FIG. 15, the fastener tape 10 further has a third tape region 13 positioned between the first and second tape regions 11 and 12. As would be well understood from FIGS. 16-18, the first tape region 11 is configured by a weft thread 6 and a plurality of warp threads 4, the second tape region 12 is configured by the weft thread 6 and a plurality of warp threads 4, and the third tape region 13 is configured by the weft thread 6 only. The fastener tape 10 is provided with the third tape region 13 made of the weft thread 6 only and accordingly, a fastener tape 10 with directional property regarding the folding of the fastener tape 10 can be supplied. In particular, the fastener tape 10 can be folded along the third tape region 13 positioned at the intermediate position between the first and second tape regions 11 and 12. The second tape region 12 of the fastener tape 10 can be overlaid onto the flap 101 of the flexible member 100 in the manner shown in FIGS. 3 and 4.

In the case shown in FIG. 15, each film 61, 62 can be selectively attached to the first tape region 11. In some cases, each film 61, 62 can be additionally attached to the second tape region 12. Note that no reinforcement film is attached to the third tape region 13. It is avoided or suppressed that the softness of the fastener tape 10 is lowered as the reinforcement film is attached to the third tape region 13.

As shown in FIGS. 15 to 18, the fastener tape 10 is configured by a plurality of warp threads 4 each extending in the lengthwise direction and at least one weft thread 6 extending in the crosswise direction orthogonal to the lengthwise direction. Each warp thread 4 extends to repeat crossing the weft thread 6 at the top surface 16 side and crossing the weft thread 6 at the bottom surface 17 side. The fastener tape 10 has a first tape region 11 where first portions 81 of the weft thread 6 crossed by the warp threads 4 are arranged at first pitch interval j1; a second tape region 12 where second portions 82 of the weft thread 6 crossed by the warp threads 4 are arranged at second pitch interval j2 that is equal to the first pitch interval j1; and a third tape region 13 positioned between the first and second tape regions 11 and 12.

The first tape region 11 includes a plurality of warp threads 4 each extending to repeat crossing the first portion 81 of the weft thread 6 at the top surface 16 side and crossing the first portion 81 of the weft thread 6 at the bottom surface 17 side. The second tape region 12 include a plurality of warp threads 4 each extending to repeat crossing the second portion 82 of the weft thread 6 at the top surface 16 side and crossing the second portion 82 of the weft thread 6 at the bottom surface 17 side. The first portion 81 of the weft thread 6 may be understood as a portion of the weft thread 6 belonging to the first tape region 11. The second portion 82 of the weft thread 6 may be understood as a portion of the weft thread 6 belonging to the second tape region 12.

The first tape region 11 is positioned closer to the first side-edge portion 1 compared with the second side-edge portion 2. The second tape region 12 is positioned closer to the second side-edge portion 2 compared with the first side-edge portion 1. The third tape region 13 is positioned closer to the second side-edge portion 2 than the first side-edge portion 1, not necessarily limited to this though. In some cases, the first side-edge portion 1 is included in the first tape region 11 and/or the second side-edge portion 2 is included in the second tape region 12. In some cases, the first side-edge portion 1 is included in a tape region having a structure different from the first tape region 11 and/or the second side-edge portion 2 is included in a tape region having a structure different from the second tape region 12.

In the third tape region 13, no warp thread 4 is provided, and the third portion 83 of the weft thread 6, extending between the first and second portions 81, 82 of the weft thread 6, are arranged at third interval j3 that is equal to the first or second pitch interval j1, j2. In some cases, the third tape region 13 is configured by the third portions 83 only arranged at the third pitch interval j3. Accordingly, a fastener tape 10 with directional property regarding the folding of the fastener tape 10 is supplied. Formation of the covering portion 19 in the fastener tape 10 for covering the side-edge portion 109 of the flexible member 100 as shown in FIG. 20 is facilitated.

In the third tape region 13 provided with no warp thread 4, a transversely-elongated window 9 across an interspace between the first and second tape regions 11 and 12 is formed between the third portions 83 adjacent in the lengthwise direction. In some cases, the weft thread 6 is configured to include thinner threads or is formed as a strand of thinner threads. The third portion 83 of the weft thread 6 is not restricted by the warp threads 4, so it may be swelled in the lengthwise direction. As a result, the transversely-elongated window 9 may be entirely or partially closed by the third portions 83 of the weft thread 6. However, even in this case, from a viewpoint of structure of tape, it would be understood that the transversely-elongated window 9 is formed between the third portions 83.

The (lengthwise) width V9 of the transversely-elongated window 9 may be constant across the interspace between the first and second tape regions 11 and 12. This may be a result of the third portions 83 of the weft thread 6 be arranged at the third pitch interval j3. The width V9 of the window 9 may vary in accordance with the swelling of the third portion 83 of the weft thread 6. That is, envisioned is fluctuation of the width V9 along the crosswise direction in accordance with the swelling of the third portion 83. The width V9 of the window 9 may be a width in accordance with a necessary interspace through which the warp thread 4 passes through between the first or second portions 81, 82 of the weft threads adjacent in the lengthwise direction. In some cases, the width V9 of the window 9 is observed when the fastener tapes 10 are stretched to left and right sides and every third portion 83 extends in parallel in the left-right direction without swelling in the lengthwise direction.

The (transverse) width L9 of the window 9 is equal to or greater than 0.3 mm in some cases. Additionally or alternatively, the (transverse) width L9 of the window 9 is equal to or less than 2.6 mm in some cases. In some cases including the illustrated example, the window 9 is a transversely-elongated rectangular window. Shape of the window 9 may change in accordance with position of the second tape region 12 relative to the first tape region 11. For example, when the second tape region 12 is moved frontward relative to the first tape region 11, the third portion 83 extends slantwise and the window 9 will be shaped to extend slantwise. In some cases, (transverse) width L9 of the window 9 is twice greater than the width V9 of the window 9.

The third tape region 13 is a region where the third portions 83 of the weft thread 6 are arranged at third pitch interval j3 and provided with no warp thread 4 extending to repeat crossing the third portion 83 of the weft thread 6 at the top surface 16 side and crossing the third portion 83 of the weft thread 6 at the bottom surface 17 side. In some cases, the third tape region 13 has water-soluble warp threads (not illustrated). The water-soluble warp thread extends to repeat crossing the third portion 83 of the weft thread 6 at the top surface 16 side and crossing the third portion 83 of the weft thread 6 at the bottom surface 17 side. The third portion 83 of the weft thread 6 may be understood as a portion of the weft thread 6 belonging to the third tape region 13. Use of the water-soluble warp threads allows existing looms to be used to produce the fastener tapes 10 of the present disclosure.

Each of the first to third portions 81, 82 and 82 may be a pair of weft-thread-portions 7 of the at least one weft thread 6 which are adjacent in the lengthwise direction. The weft-thread-portion 7 is a transversely extending portion. In some cases, the at least one weft thread 6 is turned at both opposite sides of the crosswise direction in one fastener tape 10. In some cases, a pair of portions of weft thread 6 transversely extending to the opposite sides and the warp threads are woven. This may be a result of that, when a fastener tape 10 is woven by a loom, the weft thread 6 is pulled crosswise to first side and then to second side that is opposite to the first side in the crosswise direction.

The first pitch interval j1 is greater than the (lengthwise) width of the first portion 81 of the weft thread 6 crossed by the warp thread 4. The second pitch interval j2 is greater than the (lengthwise) width of the second portion 82 of the weft thread 6 crossed by the warp thread 4. The third pitch interval j3 is greater than the (lengthwise) width of the third portion 83 of the weft thread 6. Each of the first to third pitch intervals j1, j2 and j3 may be defined as an interspace between midpoints of paired weft-thread-portions 7 in the lengthwise direction. As shown in example of FIG. 16, the pitch interval may be understood as shifted lengthwise such as pitch intervals j2' and j2".

As shown in FIGS. 16 and 17, the first tape region 11 may include a first sub tape region 21 adjacent to the third tape region 13 and a second sub tape region 22 arranged closer to the first side-edge portion 1 than the first sub tape region 21. In some cases including FIG. 16, the structure of the first sub tape region 21 differs from the structure of the second sub tape region 22. In the first sub tape region 21, the warp thread 4 extends to repeat crossing one first portion 81 at the top surface 16 side and crossing one first portion 81 at the bottom surface 17 side. In other hands, in the second sub tape region 22, the warp thread 4 extends to repeat crossing two first portions 81 at the top surface 16 side and two first portions 81 at the bottom surface 17 side. In the second sub tape region 22, exposed portions of the warp threads 4 at the tape top or bottom surface 16 or 17 are arranged obliquely. As an example, the first sub tape region 21 has a 1/1 structure, and the second sub tape region 22 has a twill-woven structure. Note that, regarding the 1/1 structure, a pair of weft-thread-portions 7 is assumed as one weft thread. In the first sub tape region 21, the warp thread 4 and the weft thread 6 are woven at a higher density compared with the second sub tape region 22. Accordingly, it is avoided or suppressed that the warp threads 4 in the first tape region 11 move toward the third tape region 13 without using adhesive agent and/or without fixing the warp threads 4 and the weft threads 6.

In some cases including FIG. 17, the structure of the first sub tape region 21 and the structure of the second sub tape region 22 are the same. In the first sub tape region 21, the warp thread 4 extends to repeat crossing two first portions 81 at the top surface 16 side and crossing two first portions 81 at the bottom surface 17 side. In the second sub tape region 22, the warp thread 4 extends to repeat crossing two first portions 81 at the top surface 16 side and crossing two first portions 81 at the bottom surface 17 side. In the first and second sub tape regions 21, 22, exposed portions of the warp threads 4 at the tape top or bottom surface 16 or 17 are arranged obliquely. As an example, the first and second sub tape regions 21 and 22 have a twill-woven structure.

The second tape region 12 includes a third sub tape region 23 adjacent to the third tape region 13 and a fourth sub tape region 24 arranged closer to the second side-edge portion 2 than the third sub tape region 23. The second tape region 12 may have a 1/1 structure. In some cases, the structure of the third sub tape region 23 and the structure of the fourth sub tape region 24 are the same or different. In some cases including FIG. 16, the structure of the third sub tape region 23 and the structure of the fourth sub tape region 24 are the same and have a 1/1 structure. In the third sub tape region 23, the warp threads 4 are woven at a higher density compared with the fourth sub tape region 24. The third and fourth sub tape regions 23, 24 have a 1/1 structure. In some cases including FIG. 17, the structure of the third sub tape region 23 and the structure of the fourth sub tape region 24 are different. The same applies to the third and fourth sub tape regions 23 and 24 of the second sub tape region 22 as described with respect to the first and second sub tape regions 21 and 22 of the first tape region 11, and thus overlapping descriptions are omitted.

The warp threads 4 in the first sub tape region 21 are thinner than the warp threads 4 in the second sub tape region 22, not necessarily limited to this though. Additionally or alternatively, the warp threads 4 in the third sub tape region 23 are thinner than the warp threads 4 in the fourth sub tape region 24. Accordingly, it is avoided or suppressed that the warp threads 4 in the first tape region 11 move toward the third tape region 13 without using adhesive agent and/or without fixing the warp threads 4 and the weft threads 6.

FIG. 18 depicts an example in which two or more tape regions are provided which are configured by the weft thread 6 only as described above. As shown in FIG. 18, the fastener tape 10 additionally includes at least one duplicate third tape region(s) 13' that has the same structure as the third tape region 13. Note that the duplicate third tape region 13' is understood as a region where no warp thread 4 is provided and the third portions 83 of the weft thread 6, each extending between the first and second portions 81, 82 of the weft thread 6, are arranged at third pitch interval j3 that is the same as the first or second pitch interval j1, j2. The duplicate third tape region 13' illustrated in FIG. 18 may have a different (transverse) width to that of the third tape region 13 illustrated in FIG. 18. A fifth sub tape region 25, having the same structure as the first sub tape region 21, is provided between the duplicate third tape region 13' and the second sub tape region 22. Sixth sub tape region 26 is provided adjacent to the duplicate third tape region 13' at the side of the first side-edge portion 1, and the tape region 26 has the same structure as the first sub tape region 21. Seventh sub tape region 27 is provided adjacent to the sixth sub tape region 26 at the side of the first side-edge portion 1, and the tape region 27 has a twill-woven structure. Regarding the structures of sub tape regions included in the first or second tape region 11 or 12, various combinations would be possible without limited to illustrated and described combinations. In some cases, the entirety of the first tape region 11 has a twill-woven structure and/or the entirety of the second tape region 12 has a twill-woven structure.

As shown in FIG. 19, the second tape region 12 can be arranged over the first tape region 11 by folding the fastener tape 10 at the third tape region 13. The side-edge portion 109 of the flap 101 of the flexible member 100 is covered by the covering portion 19 that is formed by folding the fastener tape 10 at the third tape region 13 (See FIG. 20). In other words, based on the folding of at the third tape region 13, the fastener tape 10 can have the covering portion 19 for covering the side-edge portion 109 of the flap 101 of the flexible member 100. Due to the improved folding property of the fastener tape 10 at the third tape region 13, workability for interposing the flap 101 of the flexible member 100 between the first and second tape regions 11 and 12 as shown in FIG. 20 would be improved and, alternatively or additionally, workability for sewing the fastener tape 10 and the flexible member 100 would also be improved.

Omission of bias tape 900 (See FIG. 26) may be facilitated which is otherwise required when sewing the flap 101 of the flexible member 100 and the fastener tape 10. The side-edge portion 109 of the flexible member 100 is covered by the fastener tape 10 without the use of the bias tape 900, and thus exposure of the side-edge portion 109 of the flexible member 100 is suppressed without relying on the bias tape 900. Omission of the bias tape 900 allows reduction of weight of garments. Note that, the transversely extending third portions 83 are arranged at a constant pitch interval j3 in the lengthwise direction in the third tape region 13, and this gives a directional property regarding the folding of the fastener tape 10.

In some cases, the transverse interspace W1*z* between the fastener element 30 and the third tape region 13 is greater than the (transverse) width W2 of the second tape region 12 (See FIG. 19). In other words, the (transverse) width W2 of the second tape region 12 is lesser than the crosswise interspace W1 between the fastener element 30 and the third tape region 13.

FIG. 21 shows a method of sewing of the present disclosure. This method of sewing includes: folding the fastener tape 10 at the third tape region 13 of the fastener tape 10; and sewing the flexible member 100 and the fastener tape 10 such that the flap 101 of the flexible member 100 is interposed between the first tape region 11 and the second tape region 12 of the fastener tape 10. These steps may be performed at different timings or at the same timing.

The flap 101 of the flexible member 100 is interposed, by the folding of the fastener tape 10, between the first tape region 11 and the second tape region 12 of the fastener tape 10. Typical process of sewing the flexible member 100 and the fastener tape 10 is shown in FIGS. 2-5. Sewing can include: (i) arranging the flap 101 of the flexible member 100 onto the first tape region 11 of the fastener tape 10 and sewing them; (ii) sewing the flexible member 100 and the fastener tape 10 such that the flap 101 of the flexible member 100 is interposed between the first tape region 11 and the second tape region 12 of the fastener tape 10; and (iii) sewing the flexible member 100 and the fastener tape 10 such that the main portion 102 of the flexible member 100 is overlaid onto the second tape region 12.

As shown in FIGS. 2 to 5, the flap 101 and the first tape region 11 are sewn by the sewing thread 201; the first tape region 11, the flap 101, and the second tape region 12 are sewn by the sewing thread 202; and the first tape region 11 of the fastener tape 10, the flap 101 of the flexible member 100, and the main portion 102 of the flexible member 100 are sewn by the sewing thread 203.

Figure 22:
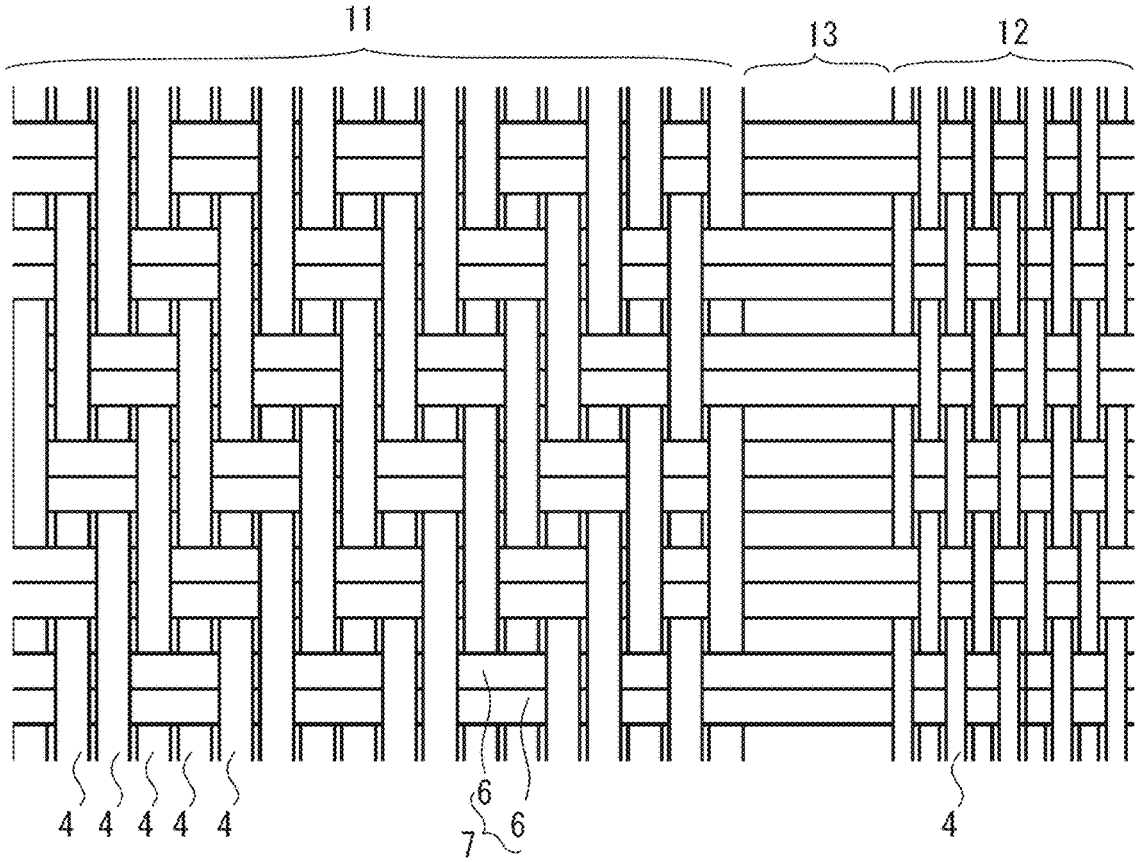
FIG. 22 is a schematic view illustrating a structure of a fastener tape in which warp thread in the first tape region and warp thread in second tape region are of different thicknesses.
Figure 23:
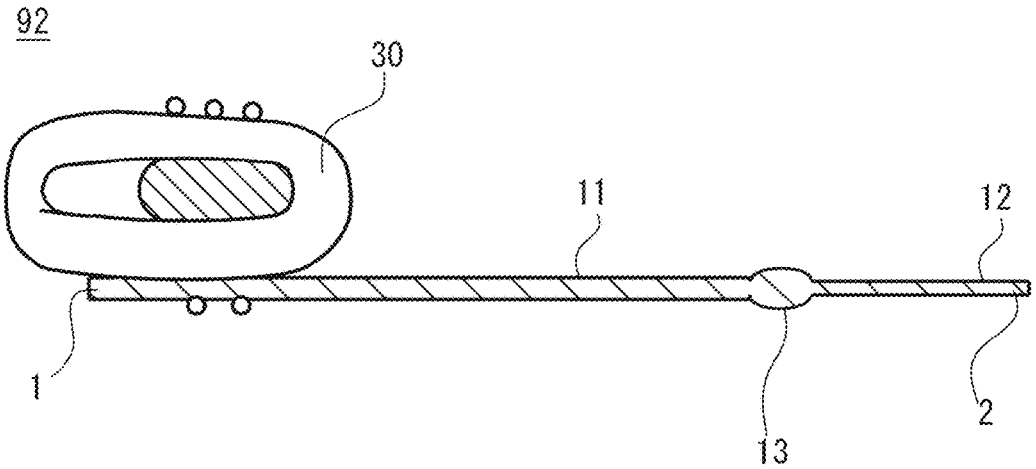
FIG. 23 is a schematic cross-sectional view of a fastener stringer including a fastener tape having a structure shown in FIG. 22.

Various embodiments will be described further in terms of the structure of the fastener tape 10 with reference to FIGS. 22-25. FIG. 22 is a schematic view illustrating a structure of the fastener tape 10 in which the warp threads 4 in the first tape region 11 and the warp thread 4 in the second tape region 12 are of different thicknesses. FIG. 23 is a schematic cross-sectional view of the fastener stringer including a fastener tape having a structure shown in FIG. 22. It is envisioned that the third tape region 13 is interposed between the first tape region 11 having greater thickness and the second tape region 12 having lesser thickness.

Figure 24:
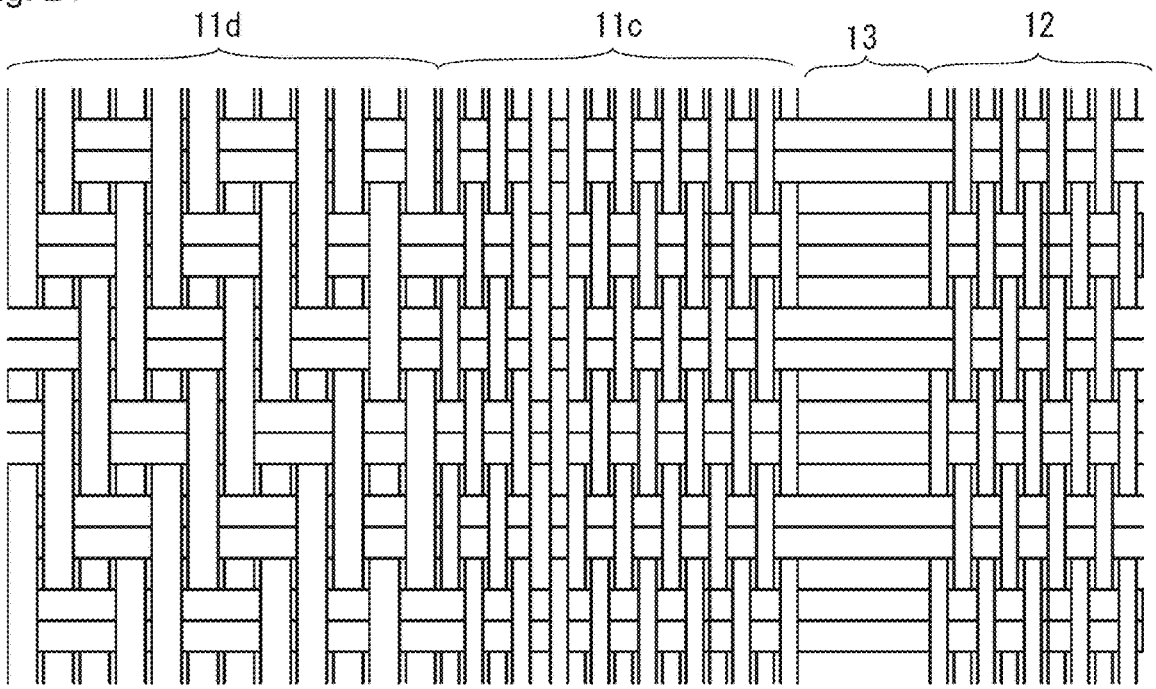
FIG. 24 is a schematic view illustrating a tape structure in which a first tape region of a fastener tape is divided into two regions, wherein thinner (fine) warp threads are used for a tape region arranged closer to a second side-edge portion and thicker warp threads are used for a tape region arranged closer to a first side-edge portion.
Figure 25:
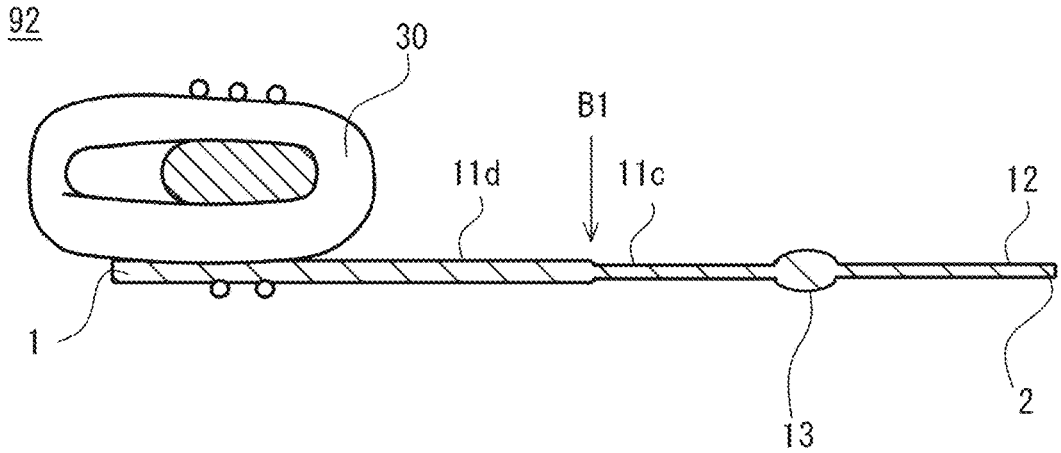
FIG. 25 is a schematic cross-sectional view of a fastener stringer with a fastener tape having a structure shown in FIG. 24.

As shown in FIG. 24, the first tape region 11 of the fastener tape 10 is divided into two regions. Thinner warp threads are used for the tape region 11*c* arranged closer to the second side-edge portion 2, and thicker warp threads are used for the tape region 11*d* arranged closer to the first side-edge portion 1. FIG. 25 is a schematic cross-sectional view of the fastener stringer with the fastener tape structured as shown in FIG. 24. Embodiment is envisioned where a boundary B1 regarding the difference in tape thickness of the fastener tape 10 is positioned at the intermediate position between the third tape region 13 and the fastener element 30.

Experiments were conducted to prove that workability for process of sewing is improved by the fastener tape or the slide fastener of the present disclosure.

As a working example, process was evaluated in which the sewing thread 202 shown in FIG. 4 was penetrated through respective portions under conditions shown in Chart 1 below. L&M Sewability Tester (SDL ATLAB) was used for measurement of penetration resistance. Penetration resistance was measured while objects of measurement (the fastener tape 10, the flexible member 100) were not overlaid. Each value of penetration resistance is an average of 100 measurements. The total of penetration resistance was calculated by adding the respective values of penetration resistance.

CHART 1

| | Thickness (mm) | Penetration resistance (g) |
|---|---|---|
| Overlap region 11a | 0.42 | 55 |
| Flap 101 | 0.59 | 86 |
| Overlap region 12a | 0.29 | 18 |
| Total | 1.30 | 159 |

As a comparative example, process was evaluated in which the sewing thread 209 shown in FIG. 26 was penetrated through respective portions under conditions shown in Chart 2 below. Note that, in the comparative example, penetration resistance was measured under the same condition as the working examples. Penetration resistance was measured while the objects of measurement (the bias tape 900, the fastener tape 10, and the flexible member 100) were not overlaid.

CHART 2

| | Thickness (mm) | Penetration resistance (g) |
|---|---|---|
| Bias tape 900 | 0.10 | 62 |
| Bias tape 900 | 0.10 | 62 |
| Fastener tape 10 | 0.45 | 35 |
| Flap 101 | 0.59 | 86 |
| Bias tape 900 | 0.10 | 62 |
| Bias tape 900 | 0.10 | 62 |
| Total | 1.44 | 369 |

The working example was superior over the comparative example from both aspects of thickness and penetration resistance.

Based on the above teachings, a skilled person in the art would be able to add various modifications to the respective embodiments. Reference numerals in Claims are just for reference and should not be referred for the purpose of narrowly construing the scope of claims.

REFERENCE SIGNS LIST

100 Flexible member
101 Flap
91 Slide fastener
92 Fastener stringer
40 Slider
10 Fastener tape
11 First tape region
11*a* (First) overlap region
12 Second tape region
12*a* (Second) overlap region
13 Third tape region
1 First side-edge portion
2 Second side-edge portion
4 Warp thread
6 Weft thread
7 Weft-thread-portion
9 Window

The invention claimed is:

1. A slide fastener coupled to a flexible member, the slide fastener comprising:

a pair of fastener stringers, each of the fastener stringers having a fastener tape having a width defined by a first side-edge portion and a second side-edge portion which extend in an elongation direction of the fastener tape, and a fastener element provided on the first side-edge portion; and one or more sliders for opening and closing the pair of fastener stringers, wherein the fastener tape includes, in a direction of the width of the fastener tape, a first tape region onto which a flap of the flexible member is overlaid and a second tape region positioned between the first tape region and the second side-edge portion, and the fastener tape is folded such that the flap is interposed between the first tape region and the second tape region.

2. The slide fastener of claim 1, wherein the second tape region has a thickness that differs from a thickness of the first tape region; or the second tape region is thinner than at least a part of the first tape region; or the second tape region includes a respective warp thread having a different thickness compared with a respective warp thread in the first tape region; or warp threads in the second tape region are thinner than warp threads in the first tape region.

3. The slide fastener of claim 1, wherein the second tape region includes a respective warp thread that differs from a respective warp thread in the first tape region.

4. The slide fastener of claim 3, wherein the respective warp thread in the second tape region is made of filaments, each of these filaments thinner than a filament of the respective warp thread in the first tape region.

5. The slide fastener of claim 1, wherein the first tape region has a twill-woven structure, and the second tape region has a plain-woven structure.

6. The slide fastener of claim 1, wherein the fastener tape further includes a third tape region positioned between the first tape region and the second tape region, the first tape region including a weft thread and a plurality of warp threads, the second tape region including the weft thread and a plurality of warp threads, and the third tape region consisting of the weft thread.

7. The slide fastener of claim 6, wherein the flap of the flexible member has a side-edge portion covered by a covering portion formed by folding of the fastener tape at the third tape region.

8. The slide fastener of claim 1, wherein the first tape region is wider than the second tape region.

9. The slide fastener of claim 1, wherein the fastener tape consists of a plurality of warp threads and at least one weft thread.

10. The slide fastener of claim 1, the flexible member is folded such that the second tape region is interposed between the flap and a main portion of the flexible member.

11. A fastener stringer comprising:

a fastener tape having first and second side-edge portions extending along a lengthwise direction; and a fastener element arranged onto the fastener tape, the fastener tape configured by a plurality of warp threads and at least one weft thread, each warp thread extending in the lengthwise direction, the weft thread extending in a crosswise direction that is orthogonal to the lengthwise direction, and each warp thread extending to repeat crossing over the weft thread at a tape top surface side and crossing over the weft thread at a tape bottom surface side, the fastener tape comprising:

a first tape region in which first portions of the weft thread are arranged at a first pitch interval, the first portion being a portion crossed by the warp threads;

a second tape region in which second portions of the weft thread are arranged at a second pitch interval, the second portion being crossed by the warp threads and the second pitch interval being same as the first pitch interval; and a third tape region positioned between the first tape region and the second tape region and including third portions of the weft thread arranged at third pitch interval that is equal to the first or second pitch intervals, the third portion extending between the first and second portions of the weft thread and none of the warp threads are provided in the third tape region, wherein the first tape region is positioned closer to the first side-edge portion than the second side-edge portion, the second tape region is positioned closer to the second side-edge portion than the first side-edge portion, the third tape region is positioned closer to the second side-edge portion than the first side-edge portion, and the fastener element is arranged onto the first tape region and onto the first side-edge portion, wherein the first tape region includes a first sub tape region adjacently arranged to the third tape region and a second sub tape region arranged closer to the first side-edge portion than the first sub tape region, and wherein a structure of the first sub tape region differs from a structure of the second sub tape region.

12. The fastener stringer of claim 11, wherein each of the first to third portions is a pair of weft-thread-portions adjacently arranged in the lengthwise direction, the pair of weft-thread-portions being included in the at least one weft thread.

13. The fastener stringer of claim 11, wherein windows are formed between the third portions adjacently arranged in the lengthwise direction, each of the windows transversely elongated corresponding to an interspace between the first tape region and the second tape region, and wherein a width of the window in the lengthwise direction is in accordance with a space required for at least one of the warp threads to pass through between the first portions or the second portions of the weft thread which are adjacently arranged in the lengthwise direction.

14. The fastener stringer of claim 11, wherein windows are formed between the third portions adjacently arranged in the lengthwise direction, each of the windows transversely elongated corresponding to an interspace between the first tape region and the second tape region, and wherein a width of the window in the crosswise direction is greater than twice a width of the window in the lengthwise direction.

15. The fastener stringer of claim 11, wherein the warp threads and the weft thread are woven at a higher density in the first sub tape region compared to the second sub tape region; or the first sub tape region is configured to have a 1/1 structure; or the warp threads in the first sub tape region are thinner than the warp threads in the second sub tape region.

16. The fastener stringer of claim 11, wherein the second tape region has a 1/1 structure.

17. The fastener stringer of claim 11, wherein the second tape region includes a third sub tape region adjacently arranged to the third tape region and a fourth sub tape region arranged closer to the second side-edge portion than the third sub tape region, and wherein a structure of the third sub tape region differs from a structure of the fourth sub tape region.

18. The fastener stringer of claim 17, wherein the warp threads and the weft thread are woven at a higher density in the third sub tape region compared to the fourth sub tape region; or the third sub tape region is configured to have a 1/1 structure; or the warp threads in the third sub tape region are thinner than the warp threads in the fourth sub tape region.

19. A slide fastener comprising:

a pair of fastener stringers, each fastener stringer being in accordance with claim 11; and a slider for opening the pair of fastener stringers.

20. A garment comprising:

the slide fastener of claim 19; and a flexible member to which the slide fastener is sewn, wherein the flexible member and the fastener tape are sewn such that a flap of the flexible member is interposed between the first tape region and the second tape region of the fastener tape.

* * * * *